US005577674A

United States Patent [19]

Altonji et al.

[11] Patent Number: 5,577,674

[45] **Date of Patent: *Nov. 26, 1996**

[54] WASTE PULPING AND LIQUID EXTRACTION SYSTEM AND METHOD INCLUDING AUTOMATIC BAG FEEDING

[75] Inventors: Robert W. Altonji, Coatesville; Robert J. Cohn, Dallas; Steven M. Eno, Strasburg; Albert Kolvites, Mountaintop, all of Pa.

[73] Assignee: Somat Corporation, Coatesville, Pa.

[ * ] Notice: The term of this patent shall not extend beyond the expiration date of Pat. No. 5,451,004.

[21] Appl. No.: 335,063

[22] Filed: Nov. 3, 1994

Related U.S. Application Data

[63] Continuation of Ser. No. 302,528, Sep. 8, 1994, abandoned, which is a continuation-in-part of Ser. No. 223,526, Apr. 6, 1994, abandoned, which is a continuation-in-part of Ser. No. 118,433, Sep. 8, 1993, Pat. No. 5,451,004.

[51] Int. Cl.[6] ..... B02C 23/10; B02C 23/16

[52] U.S. Cl. ..... 241/46.15; 241/74; 241/260.1

[58] Field of Search ..... 241/46.01, 46.15, 241/46.17, 74, 21, 79, 260.1, 46.02; 209/270, 234

[56] References Cited

U.S. PATENT DOCUMENTS

| | | |
|---|---|---|
| 816,446 | 3/1906 | Fiddyment et al. . |
| 1,354,528 | 10/1920 | Wertenbruch . |
| 1,713,507 | 5/1929 | Ammon . |
| 2,141,664 | 12/1938 | Ossing . |
| 2,314,723 | 3/1943 | Mankoff . |
| 2,340,009 | 1/1944 | Meakin . |
| 2,505,674 | 4/1950 | Knight . |

(List continued on next page.)

OTHER PUBLICATIONS

Somat brochure entitled "Animal Bedding and Waste Disposal Systems", copyrighted 1985.

Somat brochure entitled "Saving with Somat/How to apply a waste pulping system to your operation", copyrighted 1988.

Somat brochure entitled "Shipboard Food Waste Handling System", copyrighted 1989.

Hobart brochure entitled "Waste Equipment Systems/Reduce solid waste problems", printed 1–92.

Somat brochure entitled "The All New Somat Side–Winder/ Waste Disposal Systems by Somat", copyrighted 1976.

Set of 3 drawings to accompany item No. 1 above.

Somat brochure entitled "Foodservice Waste Disposal Systems", copyrighted 1978.

Somat brochure entitled "Somat Document Destruction Systems/ Irreversible Disintegration of Sensitive Documents", copyrighted 1985.

*Primary Examiner*—Kenneth E. Peterson
*Attorney, Agent, or Firm*—Ratner & Prestia

[57] ABSTRACT

A waste compaction and liquid extraction system and method are provided. The system includes a tank for containing liquid and solids, and a tray that seats on the tank. The tray includes a feeding mechanism for moving bags of waste across the tray, and a stuffing mechanism for pushing the bags down into the tank. A rotary disc impeller is mounted in the tank for grinding the solids to form a mixture of liquid and solids. The impeller has a rotating blade with inclined and bevelled cutting members. A stationary helical screw is horizontally mounted to the output port of the tank. The screw has a receiving end adjacent to the output port and a discharge end. The tank conducts the mixture to the receiving end of the screw. A sieve is provided having a cylindrical sieve surface surrounding the screw. The liquid drains through the sieve. The sieve is rotatably mounted to the output port of the tank. The sieve rotates about the screw to move the solids longitudinally towards the discharge end of the screw. A restrictor at the end of the sieve maintains backpressure to squeeze liquid out of the partially dried solids. A housing surrounds the sieve. The housing is mounted to the input port of the tank for communicating liquid that drains from the sieve back to the tank by way of the input port.

19 Claims, 28 Drawing Sheets

U.S. PATENT DOCUMENTS 2,592,215 4/1952 Wandel .
2,641,165 6/1953 Wandel .
2,699,629 1/1955 Wandel .
2,718,178 9/1955 Wandel .
2,729,145 1/1956 Wandel .
2,729,146 1/1956 Wandel .
3,062,129 11/1962 Wandel .
3,164,329 1/1965 Wandel .
3,170,640 2/1965 Kolts et al. .
3,188,942 6/1965 Wandel .
3,310,241 3/1967 Wandel .
3,319,897 5/1967 Craig et al. .
3,394,649 7/1968 Kemper et al. .
3,482,788 12/1969 Newell .
3,584,800 6/1971 Dodd et al. .
3,620,460 11/1971 Hankes .
3,708,129 1/1973 Nowak .
3,774,853 11/1973 Seifert .
3,885,745 5/1975 Hankes et al. .
3,917,179 11/1975 Graf .
3,982,703 9/1976 Meyers .
4,032,446 6/1977 Miller, Jr. .
4,074,868 2/1978 Link .
4,109,872 8/1978 Couture .
4,120,457 10/1978 Link .
4,134,555 1/1979 Rosselet .
4,150,617 4/1979 Schramm et al. .
4,155,299 5/1979 Tuttle .
4,222,528 9/1980 Smith .
4,249,701 2/1981 Miller, Jr. .
4,288,254 9/1981 Gladu .
4,365,761 12/1982 Danforth .
4,434,943 3/1984 Deal .
4,454,993 6/1984 Shibata et al. .
4,582,261 4/1986 Perry .
4,621,775 11/1986 Abom et al. .
4,630,780 12/1986 Immel et al. .
4,637,555 1/1987 Furuichi et al. .
4,637,928 1/1987 Zajack, Jr. et al. .
4,640,666 2/1987 Sodergard .
4,651,636 3/1987 Fields .
4,691,867 9/1987 Iwako et al. .
4,697,746 10/1987 Nishimori .
4,778,336 10/1988 Husain .
4,781,823 11/1988 Shinozaki .
4,813,617 3/1989 Knox, Jr. et al. .
4,844,355 7/1989 Kemp, Jr. et al. .
4,911,368 3/1990 Nishimori .
4,941,970 7/1990 Ahs .
5,016,825 5/1991 Carpenter .
5,044,566 9/1991 Mitsch .
5,044,809 9/1991 Galanty et al. .
5,129,590 7/1992 Shinya .
5,160,095 11/1992 Pepper .
5,437,414 8/1995 Hall ..... 241/74

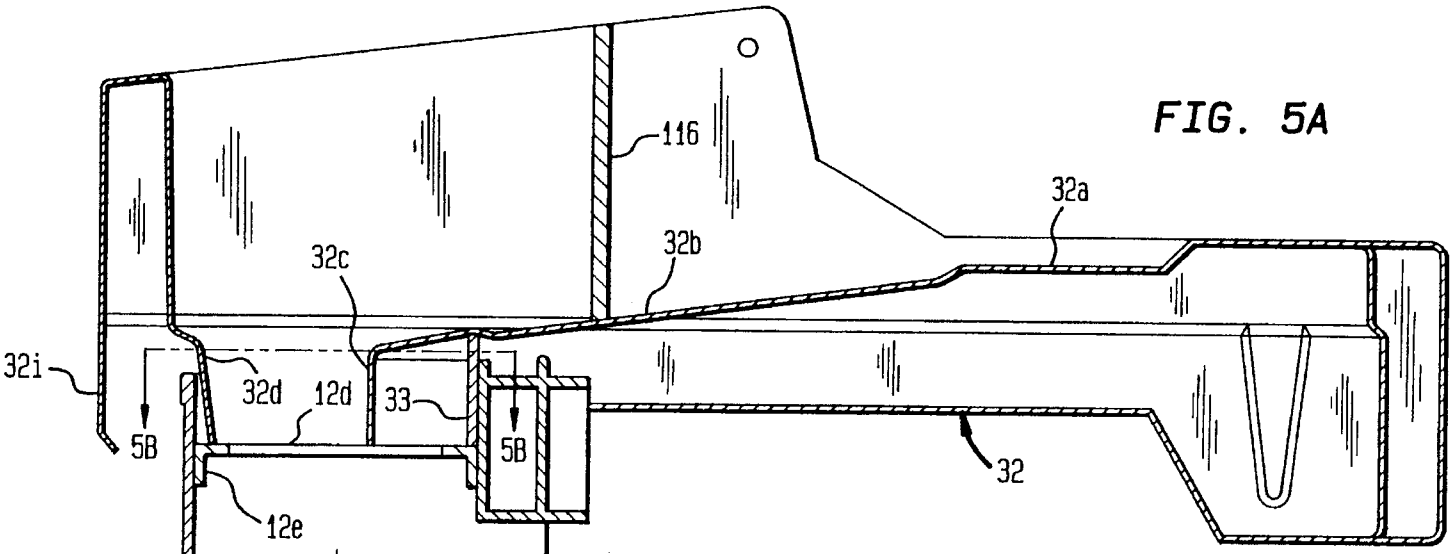
FIG. 5A
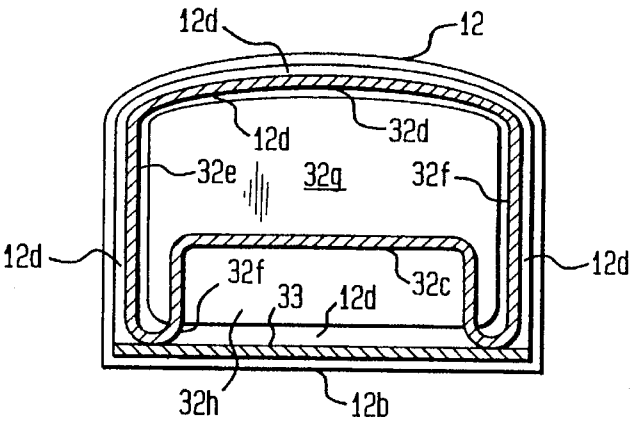
FIG. 5B
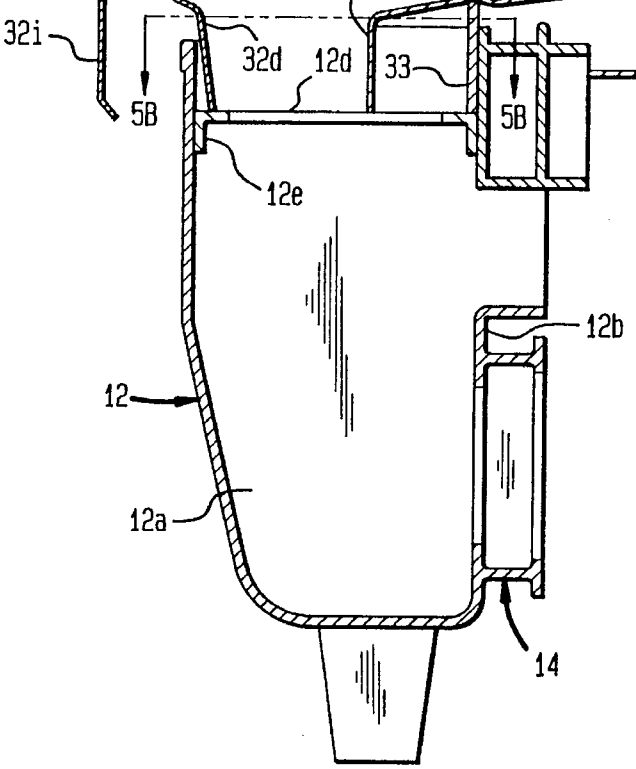

WASTE PULPING AND LIQUID EXTRACTION SYSTEM AND METHOD INCLUDING AUTOMATIC BAG FEEDING

This application is a continuation of application Ser. No. 08/302,528, filed Sep. 8, 1994, now abandoned which is a continuation-in-part of application Ser. No. 08/223,526 filed Apr. 6, 1994, now abandoned, which is a continuation-in-part of application Ser. No. 08/118,433, filed Sep. 8, 1993, now U.S. Pat. No. 5,451,004.

FIELD OF THE INVENTION

This invention relates to devices and methods for disintegrating solid waste to form a pulp and for extracting water and other liquids from the pulp prior to disposal.

BACKGROUND OF THE INVENTION

Waste reduction systems have been in use for many years. A typical system includes a pulper unit, such as the SP-75S pulper manufactured by the Somat® Corporation of Coatesville, Pa., and a liquid extraction unit, such as the HE-6S Hydra Extractor® unit produced by the same manufacturer.

In a typical pulper system, kitchen waste is placed into a large cylindrical tank partially filled with water. A cutting mechanism is installed at the bottom of the tank. The cutting mechanism includes a rotating impeller plate with rotating blades that periodically come into play with stationary blades. The rotation of the impeller grinds the waste into a pulp and circulates the water in the tank. Waste particles that are sufficiently small are discharged from the tank and pass through a conduit to the liquid extraction assembly.

The extraction assembly typically includes a vertical or near vertical feed screw surrounded by a cylindrical screen. The flighting of the screw has brushing extending radially out to the diameter of the screen. The brushing keeps the holes in the screen clear, and helps move solids in the annular region between the outer diameter of the flighting and the screen upward towards the top of the extractor. The screw rotates at a speed between 85 and 90 revolutions per minute, to advance the solid particles within the pulp vertically towards the top of the extractor. The water within the pulp drains out through the screen due to gravity, and is returned for re-use in the tank. Some systems have included inverted conical restrictor elements at the top (discharge) end, to compress the solid material before discharge for additional liquid removal. The partially dried material at the top of the feed screw is then removed for disposal.

The waste reduction systems developed in the prior art occupy a large footprint and the extractors are typically very tall, often 2 meters in height. The prior art waste handling systems also have been expensive to manufacture (and purchase). Installation often requires technicians to install lengthy conduits between the pulper unit and the extractor unit. To improve the footprint, some "close coupled" systems have been developed. These systems have a relatively short distance (e.g., about 30 centimeters) between the pulper and the extractor.

After installation, the prior art systems typically require frequent maintenance by trained personnel after installation. Impeller blades have been prone to damage when non-pulpable objects (e.g., metal flatware) become lodged in the blades. Blade replacement is a delicate operation requiring a skilled technician. The extractor unit also requires relatively frequent maintenance, to ensure that particles do not clog the openings in the screen or become hardened on the flighting of the screw. The brushing must be replaced fairly often, which is difficult and time consuming. Removing the screw and screen is a complex operation also requiring a technician.

The large space requirement and operating costs have typically limited the use of these waste reduction systems to large institutions, such as hospitals, large hotels and cruise ships. The systems have generally not been practical for small institutions (e.g., restaurants) that generate the same types of waste as the large institutions, albeit in smaller quantities.

Another disadvantage of prior art waste reduction systems is the need for an operator to manually feed articles of waste individually into the pulper. Prior art systems have typically employed a chute or water fed trough into which the articles are manually placed for disposal. Fast food restaurants produce large quantities of trash and garbage in bags collected from receptacles commonly referred to as "Thank You" boxes. Prior art waste pulping systems do not process full bags well; the bags must be opened or torn, and the waste manually fed into the pulper in small batches. This process is labor intensive.

SUMMARY OF THE INVENTION

The present invention is a waste pulping and liquid extraction apparatus and method.

The apparatus includes a tank for containing liquid and solids. The tank has an input port for receiving liquid, and a rotary disc impeller mounted in the tank for grinding the solids to form a mixture of liquid and solids.

A tray is provided, having an opening through which the solids are fed into the tank. The tray includes a mechanism for moving the solids toward the opening and pushing the solids through the opening into the tank.

A stationary helical screw is horizontally mounted directly to the tank. The screw has a receiving end adjacent to the tank and a discharge end. The tank includes a mechanism for conducting the mixture to the receiving end.

A sieve is provided, having a cylindrical sieve surface surrounding the screw. The liquid drains through the sieve surface. The sieve is rotatably mounted to the tank.

A mechanism is provided for rotating the sieve about the screw to move the solids longitudinally towards the discharge end.

A housing surrounds the sieve. The housing is mounted directly to the tank for communicating liquid that drains from the sieve back to the tank by way of the input port.

BRIEF DESCRIPTION OF THE DRAWINGS

FIG. 5*a* is a sectional view of the integrated tank and the top tray of the system shown in FIG. 1.

FIG. 5*b* is a cross sectional plan view showing the seating of the tray shown within the tank shown in FIG. 5*a*.

OVERVIEW

Figure 1:
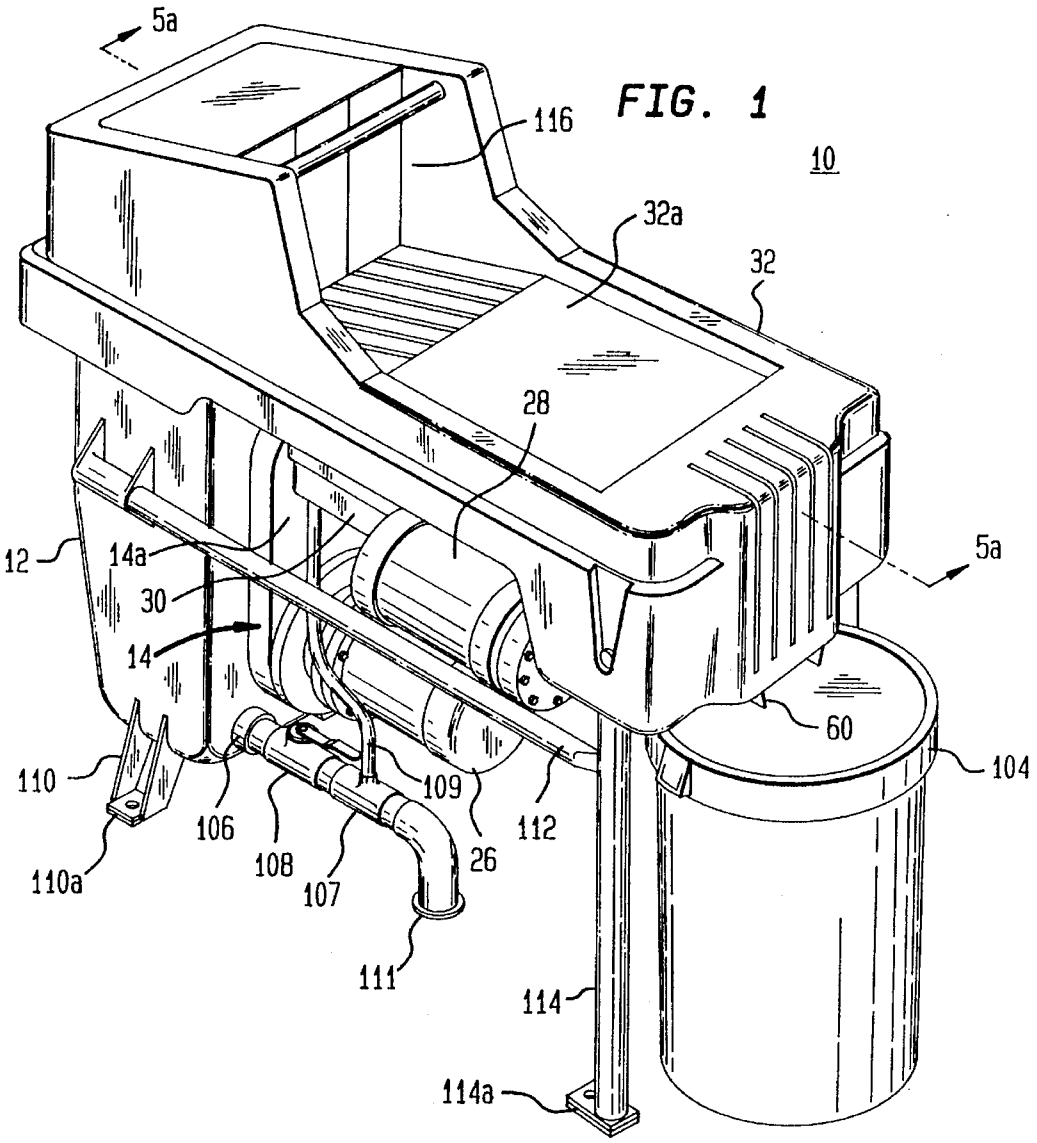
FIG. 1 is an isometric view of an exemplary system according to the invention.
Figure 2:
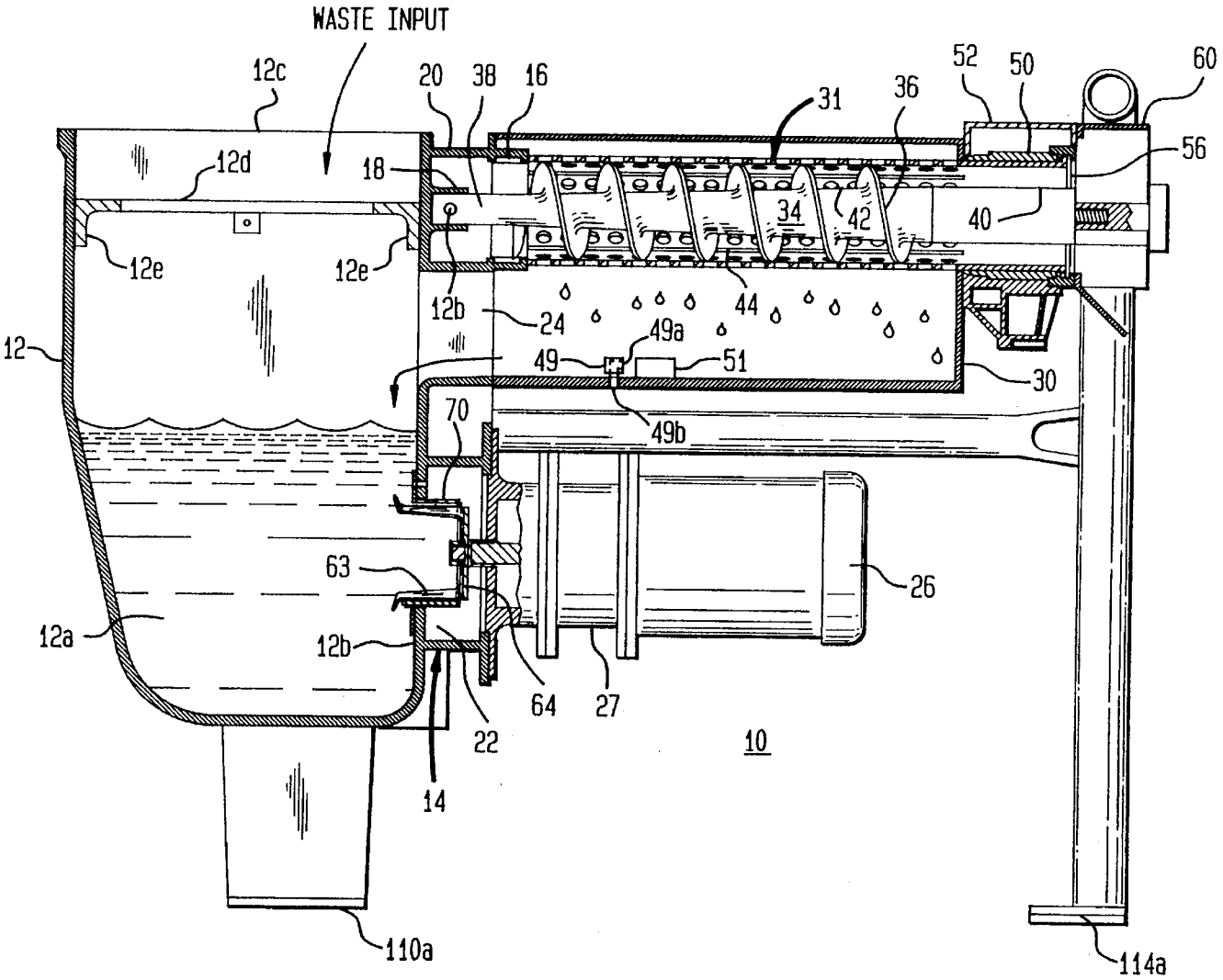
FIG. 2 is a sectional view of the system shown in FIG. 1.

FIG. 1 shows an integrated waste treatment and liquid removal system 10. FIG. 2 is a cross sectional view of system 10, with feed tray 32 removed. The operator of system 10 enters waste material (e.g. food waste, paper and plastic bags and utensils) on the top surface 32*a* of feed-tray 32. The waste material is pushed through a plurality of hanging splash guard flaps 116, which provide the inlet for receiving solid waste material. Beyond flaps 116 is an opening (outlet) in the bottom of feed tray 32, through which the waste matter falls into the top portion 12*c* of a tank 12 (shown in FIG. 2).

Tank 12 is partially filled with water. A rotary disk impeller assembly 63 (shown in FIG. 2) is attached to a side wall 12*b* of tank 12. Wall 12*b* separates the integral tank 12 into a main section 12*a* and a chamber 14. Impeller assembly 63 creates turbulence in the water so that pulpable waste is drawn towards impeller assembly 63. Impeller assembly 63 grinds waste material into a pulp or slurry. Impeller assembly 63 has a sieve ring 70 or security ring, through which small particles of pulp and liquid pass. Particles ground to a sufficiently small size pass through sieve ring 70 into a chamber 14*a*.

Impeller 63 also provides pressure to drive the mixture of liquid and solids up to the top of chamber 14 which opens into an outlet port 20 (shown in FIG. 2) of tank 12. From port 20, the mixture of liquid and solids enters the input end 38 (receiving end) of liquid extraction assembly 31 (shown in FIG. 2 and FIG. 4C), contained in a housing 30. Water is removed from the slurry in extraction assembly 31, and returned to tank 12 by way of housing 30. The solids are advanced towards the end of extractor 31, where they are expelled at the safety cover 60. The solids fall into a waste receptacle 104. Port 20 also includes respective slidably detachable mountings for the helical screw 34 and for the cylindrical screen 44 of extraction assembly 31. Screw 34 is slidably and nonorotatably mounted in a sleeve 18 within the port 20 of tank 12. Screen 44 is slidably and rotatably mounted within port 20.

Figure 3:
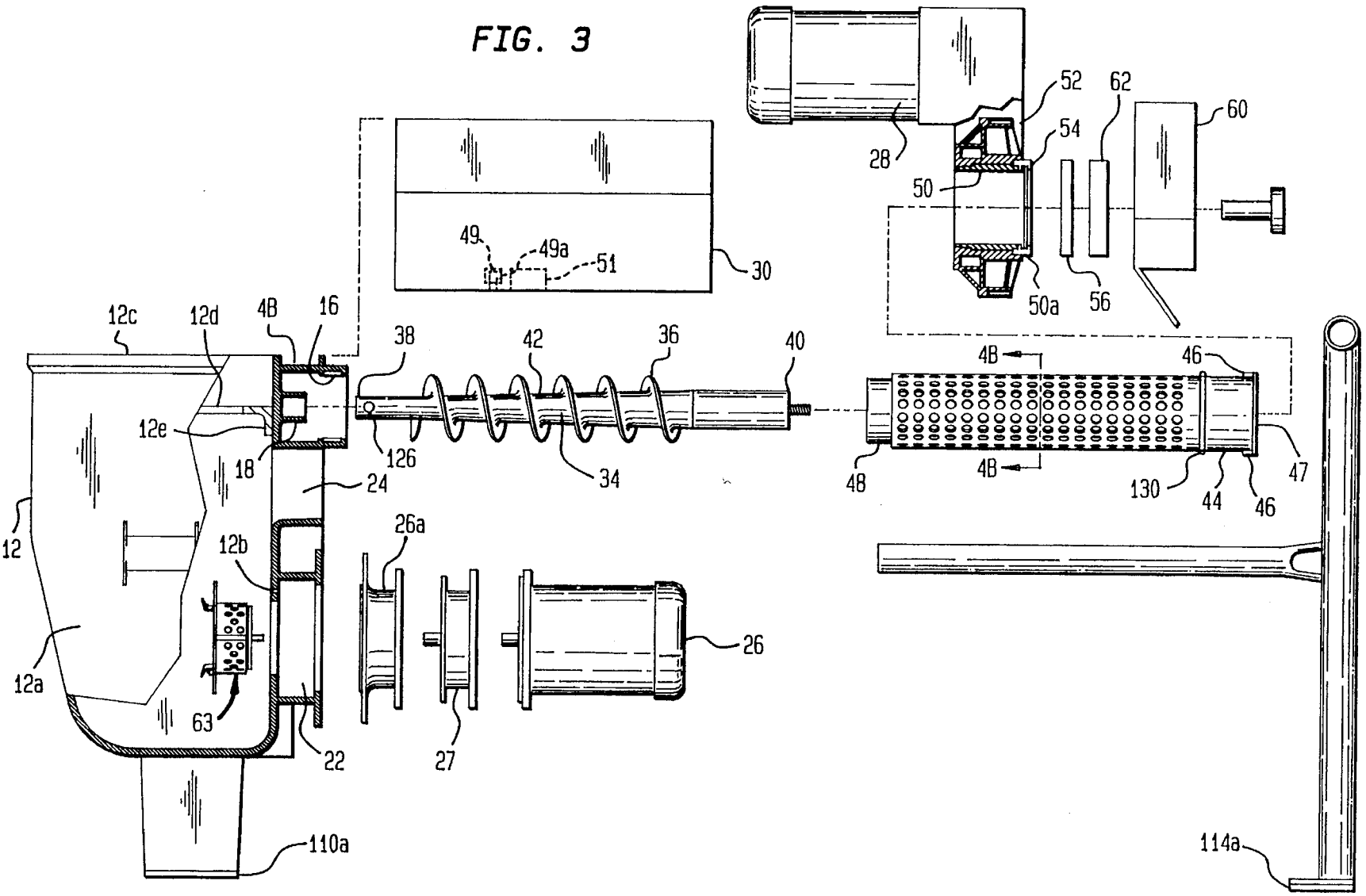
FIG. 3 is an exploded elevation view of the system shown in FIG. 1.

FIG. 3 shows the discharge end 47 of screen 44, at which a rotating mechanism is provided for engaging the outer peripheral surface of the screen 44, and for rotating screen 44. The rotating mechanism includes a rotatable collar 50. Collar 50 includes a detachable mounting for receiving screen 44 and for transmitting torque to the screen. Both helical screw 34 and rotating screen 44 may be slidably removed from system 10 quickly, without using specialized tools. A retaining mechanism such as threaded end nut 62 keeps screen 44 and screw 34 in place during operation of system 10. When nut 62 is removed, a clear path is provided for removing screw 34 and screen 44. This procedure is quick and simple enough to be performed by nontechnical personnel (e.g., dishwashing or janitorial staff).

Extraction assembly 31 is horizontal, and is mounted directly to the pressurized chamber portion 14 of tank 12. Horizontal extraction assembly 31 allows the entire system 10 as shown in FIG. 2, without feed tray 32 to fit below the counter in a typical work area, which is about 78 to 84 centimeters in height. Housing 30 of extraction assembly 31 is also directly mounted onto chamber 14 of tank 12. Housing 30 serves three purposes: it houses extraction assembly 31, to catch the liquid that is extracted. Housing 31 serves as a return conduit to carry extracted liquid back to an input port 24 of tank 12. This eliminates the need for a separate return conduit to return liquid to the tank 12. And housing 30 provides structural support for extraction assembly 31, including the motor 28 (shown in FIG. 3) and gearbox 52.

Figure 21:
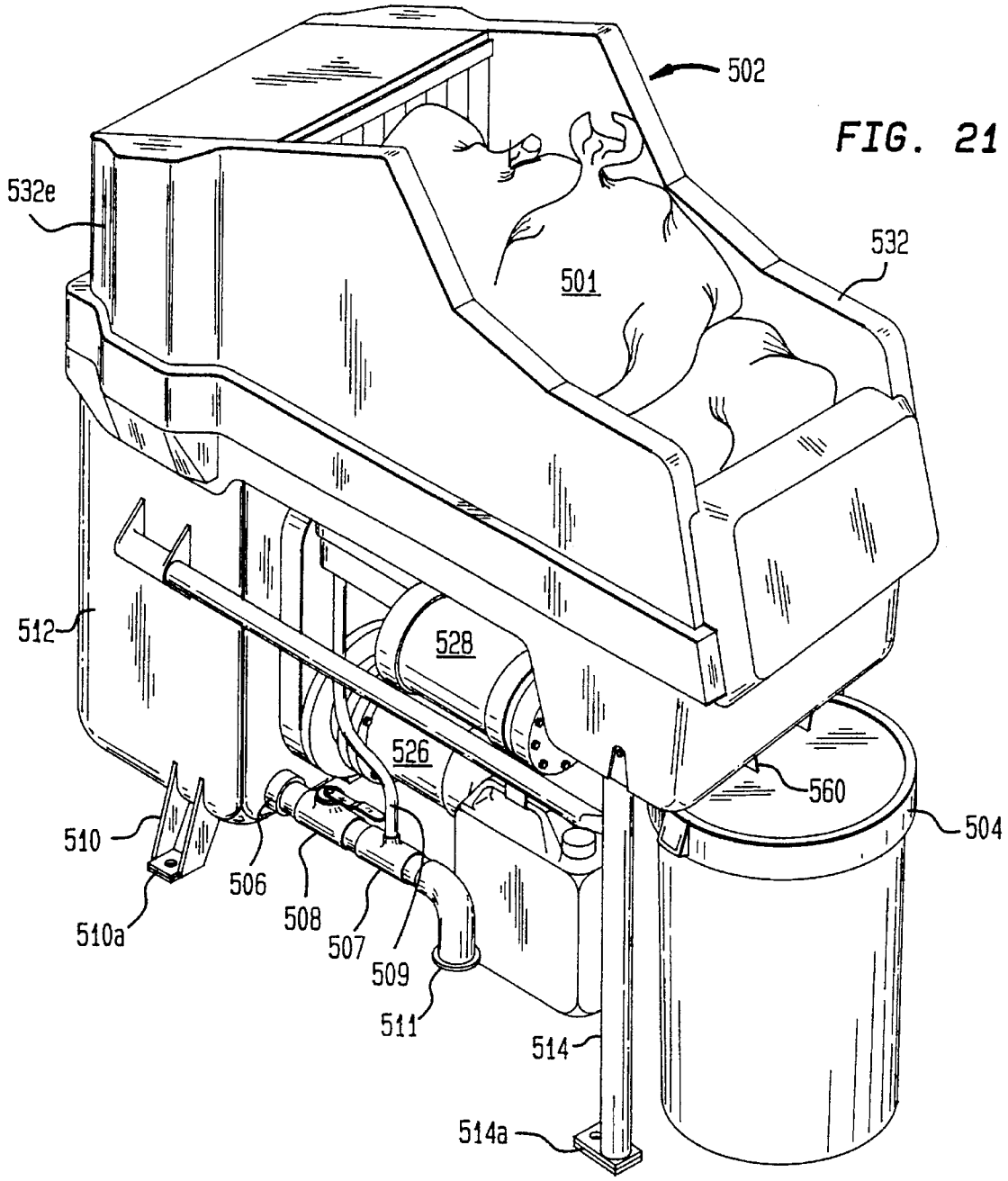
FIG. 21 is an isometric view of a second exemplary system according to the invention.
Figure 22:
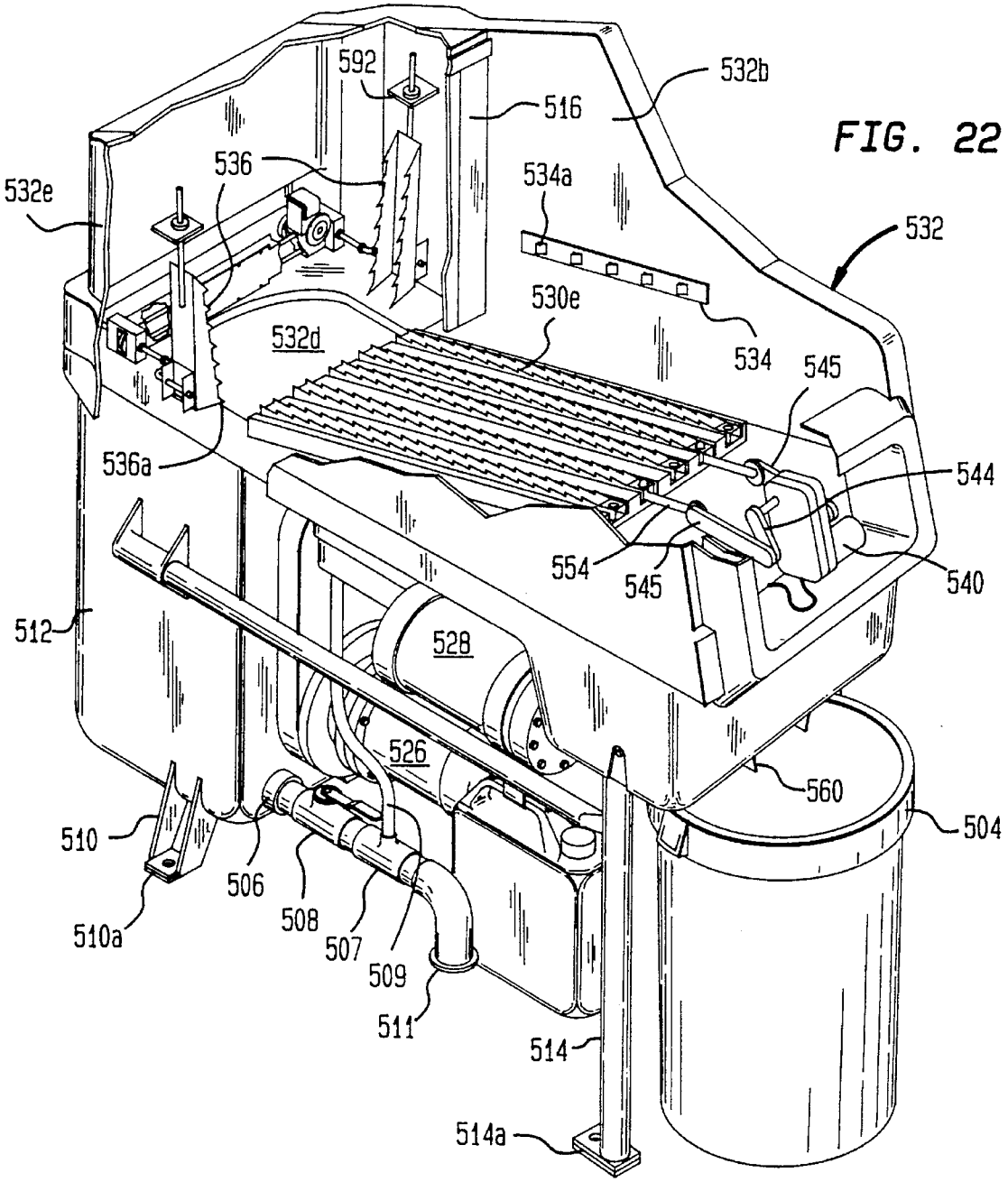
FIG. 22 is a partial cut-away view of the system shown in FIG. 21, including bag feeding apparatus.
Figure 23:
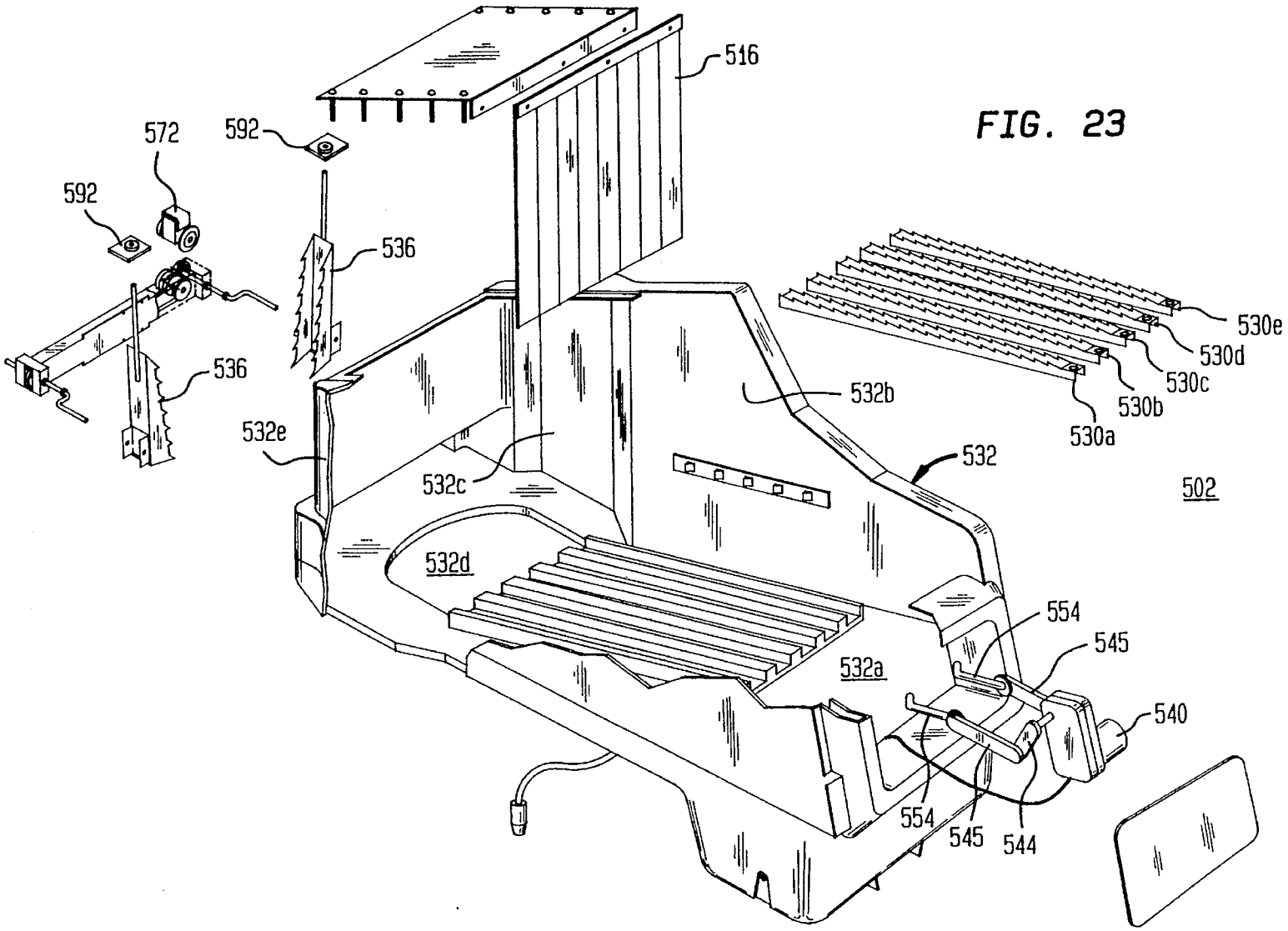
FIG. 23 is an exploded view of the system shown in FIG. 22.

FIGS. 21–23 show a second embodiment of the invention which includes an optional bag feeding apparatus 502. Bag feeding apparatus 502 receives unopened whole bags 501 of waste and automatically forces the bags into the pulping tank 512.

A plurality of toothed reciprocating feeder bars 530*a*–530*e* move bags 501 down the inclined top surface 532*a* of tray 532 towards the tank 512. An anti-rotation strip 534 is mounted on each side wall 532*b* of tray 532. Each strip 534 includes a plurality of angled tabs 534*a* which engage bag 501 and prevent the top portion of bag 501 from moving or pivoting away from tank 512. Strips 534 ensure that bag 501 moves towards tank 512, instead of merely rotating. A plurality of toothed reciprocating stuffer bars 536 receive bag 501 from the feeder bars 530*a*–530*e* and gradually force the bag into tank 512.

The operator merely drops one or more bags 501 onto feeder bars 530*a*–530*e*. Feeder bars 530*a*–530*e* convey bag 501 to stuffer bars 536, and assist in breaking bag 501 open. Stuffer bars 536 gradually feed the waste into tank 512 for pulping, without further operator intervention. Bag feeding apparatus 502 makes system 500 particularly advantageous in fast food restaurants or other locations where food waste is collected in bags from "Thank You" boxes.

DETAILED DESCRIPTION

PULPER TANK

FIG. 3 is an exploded view of the first exemplary embodiment of the system 10. Tank 12 (also shown in a perspective view in FIG. 5), provides the structure on which the remaining components of system 10 are mounted. A wall 12*b* separates tank 12 into a main portion 12*a* (which is filled with water and waste material) and a chamber 14 (shown in FIG. 5) that conducts pulverized slurry from impeller assembly 63 to extraction assembly 31. Wall 12*b* opens into the bottom section 22 of chamber 14. A middle section 14*a* of chamber 14 (shown in FIG. 5) provides a conduit connecting bottom section 22 to port 20 of tank 12. Within main portion 12*a* of tank 12, the mixture is at atmospheric pressure. The rotation of impeller assembly 63 provides an increase in pressure that propels the mixture of liquid and ground solids in bottom 22 up conduit 14*a* to port 20.

Respective motors 26 and 28 (FIG. 3) are provided for driving impeller assembly 63 and extraction assembly 31. An optional gearbox 27 may be used between motor 26 and adaptor ring 26*a* to increase the rotational speed of impeller 63 above the motor shaft speed, particularly if system 10 is powered by 50 Hz electricity.

A drain line 109 (shown in FIG. 1) couples the bottom of housing 30 to a tee 107 in a drain line 111, for draining out part of the extracted liquid to drain line 111. This causes fresh water to be supplied to tank 12 by a level control (not shown) to maintain a desired fluid level in tank 12.

Impeller assembly 63 is placed low in tank 12, so that it is difficult to accidentally contact assembly 63 while tray 32 is positioned on top of system 10 (as shown in FIG. 1), improving safety. With feed tray 32 removed, as shown in FIG. 2, impeller assembly 63 is easily accessed for maintenance, and includes replaceable, quick release stationary blades 72 and rotating blades 76. Replacement of these blades requires no special tools or technical training. Removable rotating blades 76 (explained in detail with reference to FIGS. 7–10) also feature anti-jamming features. Rotating blade 76 has inclined cutting members 78. Cutting members 78 have beveled leading edges 80. Beveled edge 80 has a helical shape, to maintain a desired gap between the different portions of the beveled edge 80 as they come into play with stationary blade 72.

Figure 5:
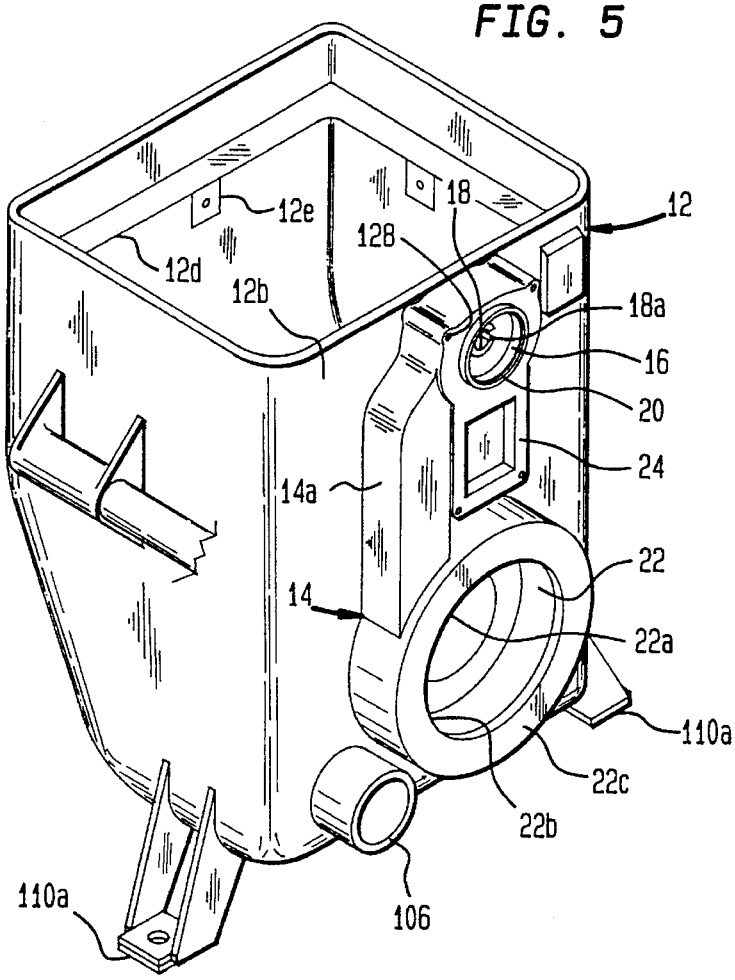
FIG. 5 is an isometric view of the integrated tank of the system shown in FIG. 1.

FIGS. 5, 5*a* and 5*b* show a horizontal sealing shelf 12*d* located near the top of tank 12. Shelf 12*d* serves as a splash guard. Shelf 12*d* extends inward approximately 2–3 centimeters from the edge of tank 12, and extends along the entire perimeter of tank 12, as shown in FIG. 5*b*. Shelf 12*d* prevents any material from being propelled out of tank 12 via a clearance that may exist between the top of tank 12 and tray 32. Shelf 12*d* may be formed separately from a flat sheet of metal including a plurality of tabs 12*e*. The tabs 12*e* are folded down 90 degrees and fastened to tank 12 by welding, fasteners or other conventional method. Alternatively, shelf 12*d* may be fastened to tank 12 by "L" shaped brackets (not shown), or shelf 12*d* may be cast integrally with tank 12.

FIG. 5*a* shows that waste placed on the downwardly sloped top surface 32*b* of tray 32 passes through flaps 116. Surface 32*b* leads to a vertical surface 32*c* that is a part of an output port 32*g* of tray 32. As best seen in FIG. 5*b*, surfaces 32*c*–32*f* form the perimeter of output port 32*g*. The bottoms of surfaces 32*c*–32*f* rest on shelf 12*d*. This configuration prevents egress of material without applying a gasket, packing material or adhesive between port 32*g* and tank 12. Nor is a tight fit required between port 32*g* and the perimeter of tank 12. Tray 32 sits loosely atop shelf 12*d*.

FIG. 5*b* shows a port 32*g* positioned remotely from the entry way formed by flaps 116, as a safety feature. An additional vertical plate 33 (shown in FIGS. 5*a* and 5*b*) prevents ejection of material from tank 12 through the opening 32*h* between surface 32*c* of tray 32 and wall 12*b* of tank 12.

Optionally, port 32*g* may be enlarged by locating surface 32*c* right next to wall 12*b* of tank 12. This would eliminate opening 32*h*, so that plate 33 would not be needed to prevent egress of material from the top of tank 12. However, if wall 32*c* is moved closer to wall 12*b* (and therefore closer to flaps 116), it would be easier for an operator to reach the impeller assembly while the machine is operating, thereby reducing safety.

Referring again to FIG. 5, in the exemplary embodiment, the bottom portion 22 of chamber 14 has a spiral shape. The radius of the bottom portion 22 increases from a minimum in section 22*a* immediately past conduit 14*a*, to a maximum at section 22*b*, just before conduit 14*a*. With this construction, the fluid rotating around bottom chamber 22 maintains a substantially constant flow velocity. This prevents stagnation from occurring in chamber 22 and enhances the pumping capability of impeller assembly 63.

Tank 12 has feet 110, at the bottom of which rubber pads 110*a* are attached. Similar pads 114*a* are attached to the bottom of legs 114. Pads 110*a* and 114*a* may reduce vibration and prevent scratching when system 10 is moved.

EXTRACTION ASSEMBLY

FIGS. 2–4C show extraction assembly 31. To allow reduction of the horizontal length of extraction assembly 31, two features improve the water removal efficiency (shown in exploded view in FIG. 4C). First, a restrictor 56 is provided adjacent to the discharge end of extraction assembly 31, for controlling the back pressure in the extraction assembly 31. Restrictor 56 raises the back pressure by retaining solid material in extraction assembly 31, so that solids are compressed further and additional liquid is removed. When the desired pressure is reached, restrictor 56 opens to allow partially dried solids to leave the system 10.

Second, extraction performance is improved and power consumption is reduced when screen 44 rotates at a speed between 200 and 250 revolutions per minute (RPM), or about two and a half times the rotational speed used in conventional apparatus. The centrifugal force drives the liquid directly in the radial direction, so that liquid removal is enhanced.

Figure 17:
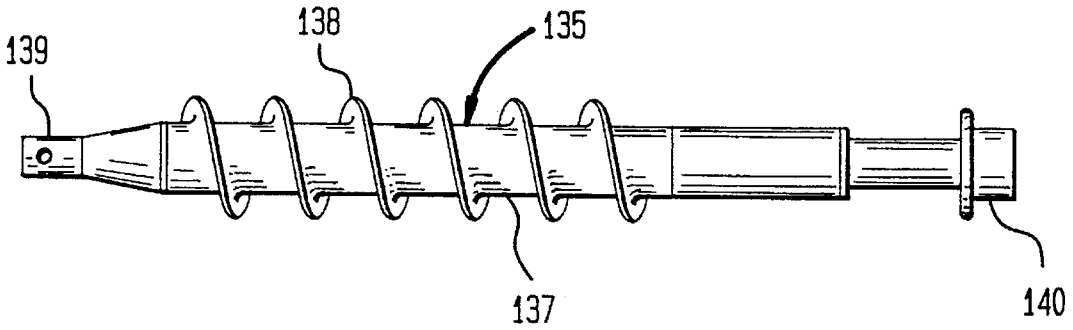
FIG. 17 is a side elevation view of a second exemplary extractor screw suitable for mounting as shown in FIG. 15.

FIG. 17 shows a screw 135 having a central shaft 137 of constant diameter. Restrictor 56 and/or the screen speed between 200 and 250 RPM may be used with constant diameter screw 135. An option for increasing water removal is a tapered screw 34, as shown in FIG. 3. The shaft 42 of screw 34 is smallest at the input end 38, and continuously increases towards the discharge end 40 of screw 34. The flighting 36 of screw 34 maintains a constant dimension throughout the length of screw 34, as does the sieve surface of extractor sieve 44. Thus, an annular cylindrical region formed between the shaft of screw 34, the flighting 36 and the sieve 44 increases in inner diameter from the input end to the discharge end. This reduces the volume continuously, resulting in compression of the partially dried material towards the discharge end. This compression causes additional liquid removal.

The top of conduit 14*a* opens into an output port 20 onto which extraction assembly 31 is mounted. An inner sleeve 18 slidably receives the input end 38 of helical screw 34. Exemplary sleeve 18 includes two horizontal slots 18*a* (shown in FIG. 5) for receiving a dowel pin 126 that is mounted transversely at the receiving end of screw 34. The slot 18*a* and pin 126 arrangement prevents rotational movement of screw 34, while absorbing axial loading on screw 34 in the direction of tank 12. This allows for easy sliding removal of screw 34. Screw 34 is thus detachably mounted in sleeve 18. Optionally, other torque reaction mechanisms such as a slot and tab arrangement may be used. For example, end 38 may be formed into a tab (not shown) that fits into a slot (not shown) in port 20.

Near the opening of port 20, a bushing 16 is mounted for slidably receiving the input end 48 of sieve 44 (FIG. 3). Exemplary bushing 16 is formed of an ultra high molecular weight polyethylene, or of SAE 660 bronze. Bushing 16 acts as a self lubricating bearing, reducing friction as sieve 44 rotates, regardless of whether bushing 16 is wet or dry. Other materials may also be used for bushing 16. Bushing 16 may also have a longitudinal slot so that it may easily be twisted and pried out for replacement if necessary.

Extraction assembly 31 may be cantilever mounted to port 20 of tank 12. In addition to the slidable couplings of screw 34 and sieve 44 to the port 20, exemplary housing 30 is bolted to mating bolt holes 128 on tank 12, as shown in FIG. 5. A gasket (not shown) is placed between housing 30 and the surface of port 20 of tank 12, to provide a water tight seal. The rotating mechanism is cantilever mounted to the discharge end of housing 30.

Exemplary screen 44 is a perforated tube. On the inside surface of sieve 44 a plurality of longitudinal grooves 43 may be provided (best seen in FIG. 4B) extending from input end 48 to the end of flighting 36. The wall thickness of sieve 44 is exaggerated in FIG. 4B to more clearly show grooves 43. Grooves 43 assist in moving the solids in sieve 44 in the longitudinal direction towards discharge end 46 when sieve 44 rotates. Grooves 43 also reduce movement of solids in the tangential direction relative to sieve 44. Pushing the solids in the longitudinal direction helps squeeze the liquid out of the solids, but movement in the tangential direction is not effective to remove additional liquid. Friction between the solids and sieve 44 is minimized if the solids move longitudinally relative to sieve 44, but not in the tangential (transverse) direction relative to sieve 44.

Referring again to FIG. 3, the exemplary rotating mechanism includes a gear box 52 to which a motor 28 is mounted. Motor 28 is coupled via gears to a collar 50 inside gearbox 52. Collar 50 surrounds the periphery of sieve 44 at its discharge end 47. Collar 50 includes an arrangement of slots 50*a* that are adapted to receive a plurality of mating keys 46. Keys 46 are integrally attached to the discharge end 47 of sieve 44. Keys 46 are slidably received by slots 50*a* when sieve 44 is slid through collar 50, through the length of housing 30, and into bushing 16 of port 20. The slot 50*a* and key 46 arrangement provides a positive mechanism for transmitting torque from collar 50 to sieve 44 for rotating the sieve.

The rotating mechanism may optionally include other mechanical transmissions for transmitting torque from motor 28 to sieve 44. For example, instead of gear box 52, a belt drive transmission may be used. The belt may be coupled to a collar such as collar 50, or the belt may be directly coupled to the outer periphery of the sieve 44.

Figure 19:
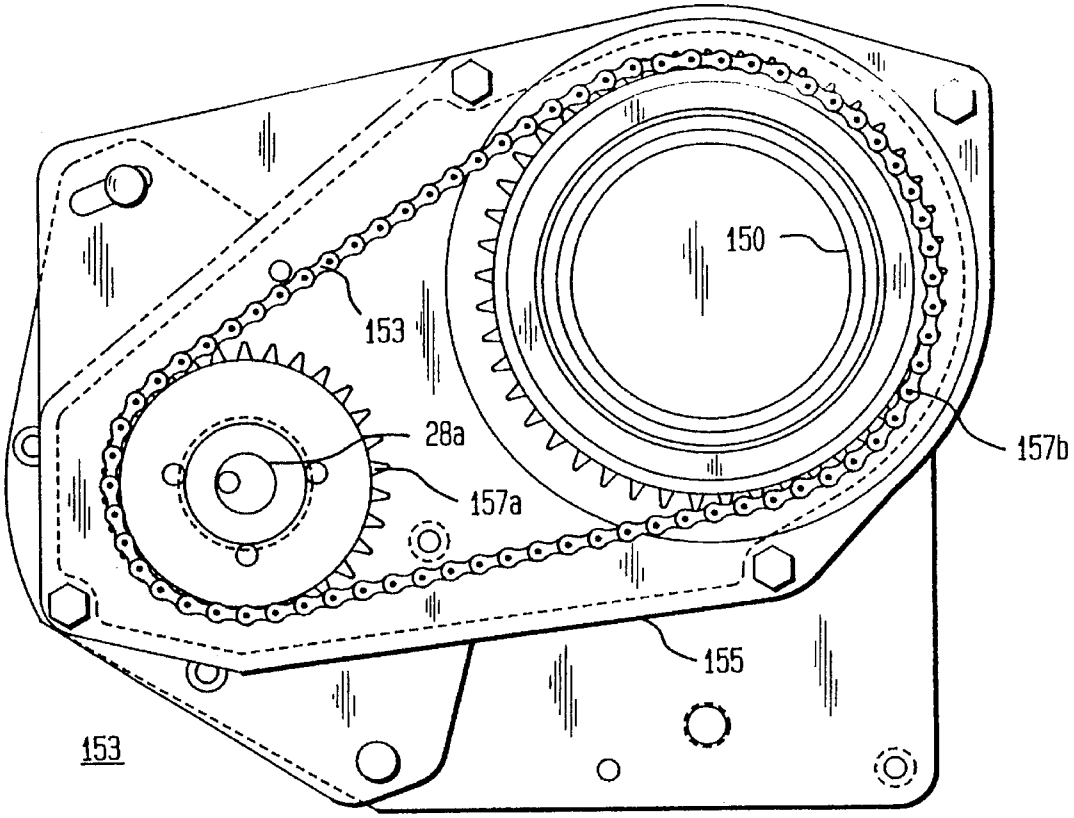
FIG. 19 is a front elevation sectional view of the chain box shown in FIG. 18.
Figure 18:
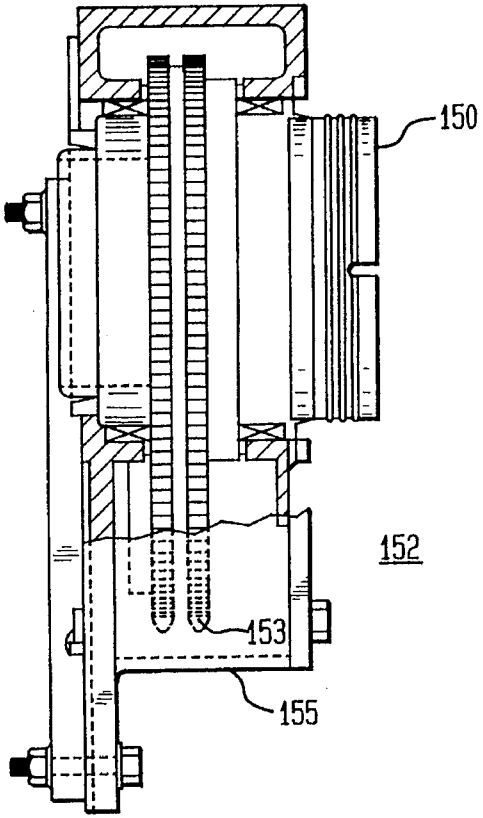
FIG. 18 is a side elevation sectional view of the chain box shown in FIG. 15.

FIGS. 18 and 19 show another embodiment of the rotating mechanism, including a chain box 152. Shaft 28*a* of motor 28 (shown in FIG. 1) is coupled to collar 150 by sprockets 157*a* and 157*b* and a chain 153. Chain box 152 includes an oil-filled, sealed case 155 for lubricating sprockets 157*a* and 157*b* and chain 153. Collar 150 is similar to collar 50 (shown in FIG. 3), except that collar 150 is coupled to and driven by a sprocket 157*b*. Also, collar 150 is located inside an oil-filled case 155, so collar 150 is lubricated, giving it a prolonged life as compared to collar 50. Because of chain 153, chain box 152 transmits more power than would be possible using a conventional timing belt or V-belt. In another variation (not shown) chain box 152 may also be bolted to a gearbox that is coupled to the motor.

Referring again to FIG. 3, a suitable seal, such as O-ring seal 130 may optionally be placed on the periphery of sieve 44 near the discharge end 47, to provide a positive water tight seal between the sieve 44 and the collar 50.

Once screw 34 and sieve 44 are in position, a retaining nut 62 is applied to hold sieve 44 in place. Exemplary nut 62 has a large acme screw thread and a knurled outer surface, so that nut 62 may be easily installed or removed. Optionally, a nut 162 (shown in FIG. 16) that includes one or more keys or slots 162*a* may be used. Slots 162*a* may be gripped by a spanner wrench to apply greater torque. Referring again to FIG. 3, no components or objects mechanically block the path for removing screw 34 or screen 44, other than nut 62 and feed tray 32. Once tray 32 and nut 62 are removed, screw 34 and sieve 44 slide out easily. Additionally, nut 62 transmits the axial load of sieve 44 to the mechanical transmission (e.g., by way of collar 50).

With screw 34 and screen 44 cantilever mounted from port 20 of tank 12, and screen 44 driven at its periphery by rotating mechanism 28, 50 and 52 as shown, motor 28 and gearbox 52 are easily isolated from the liquid inside screen 44. In an alternative embodiment (not shown), screw 34 could rotate and screen 44 could be held stationary. Screw 34 would then have to be driven at receiving end 38 so as not to block egress of solids from discharge end 40. To drive screw 34 from receiving end 38, rotating mechanism 28, 52 would have to be positioned inside tank 12, near tank opening 12*c*. Such a configuration, however, would expose motor 28 and gearbox 52 to the wet and corrosive environment of tank 12.

Figure 4A:
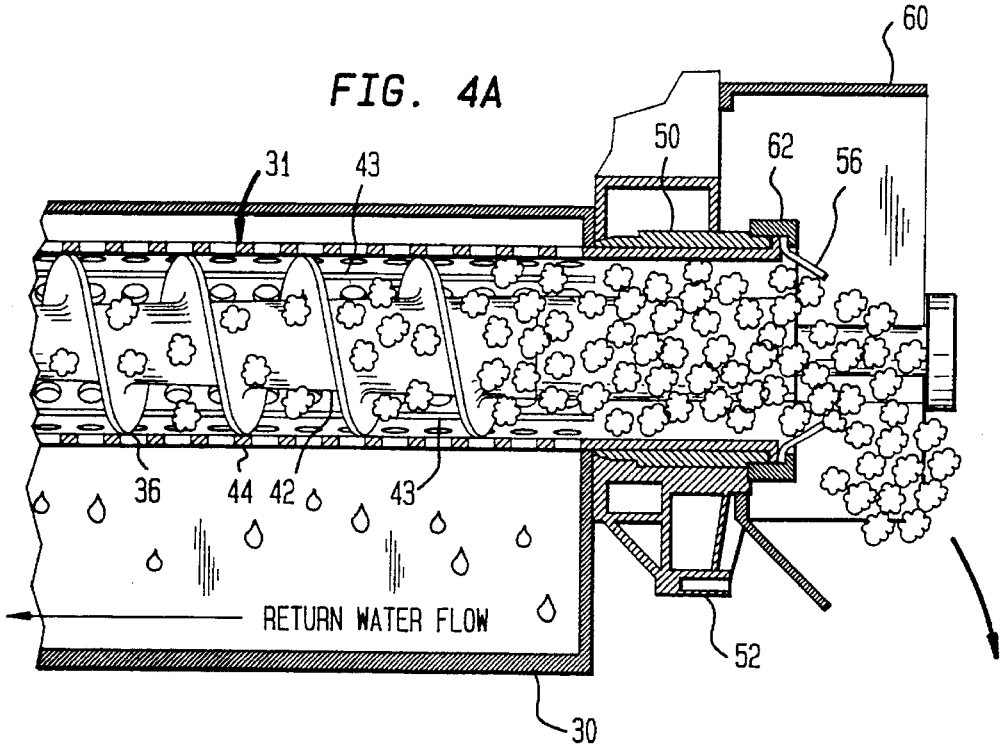
FIG. 4A is a detailed sectional view of the discharge end of the extraction system of the system shown in FIG. 2.
Figure 4B:
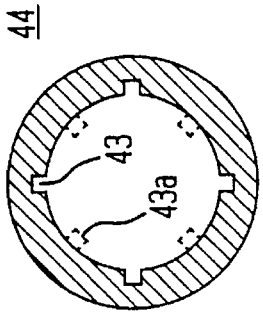
FIG. 4B is a cross sectional view of the sieve shown in FIG. 3.
Figure 4C:
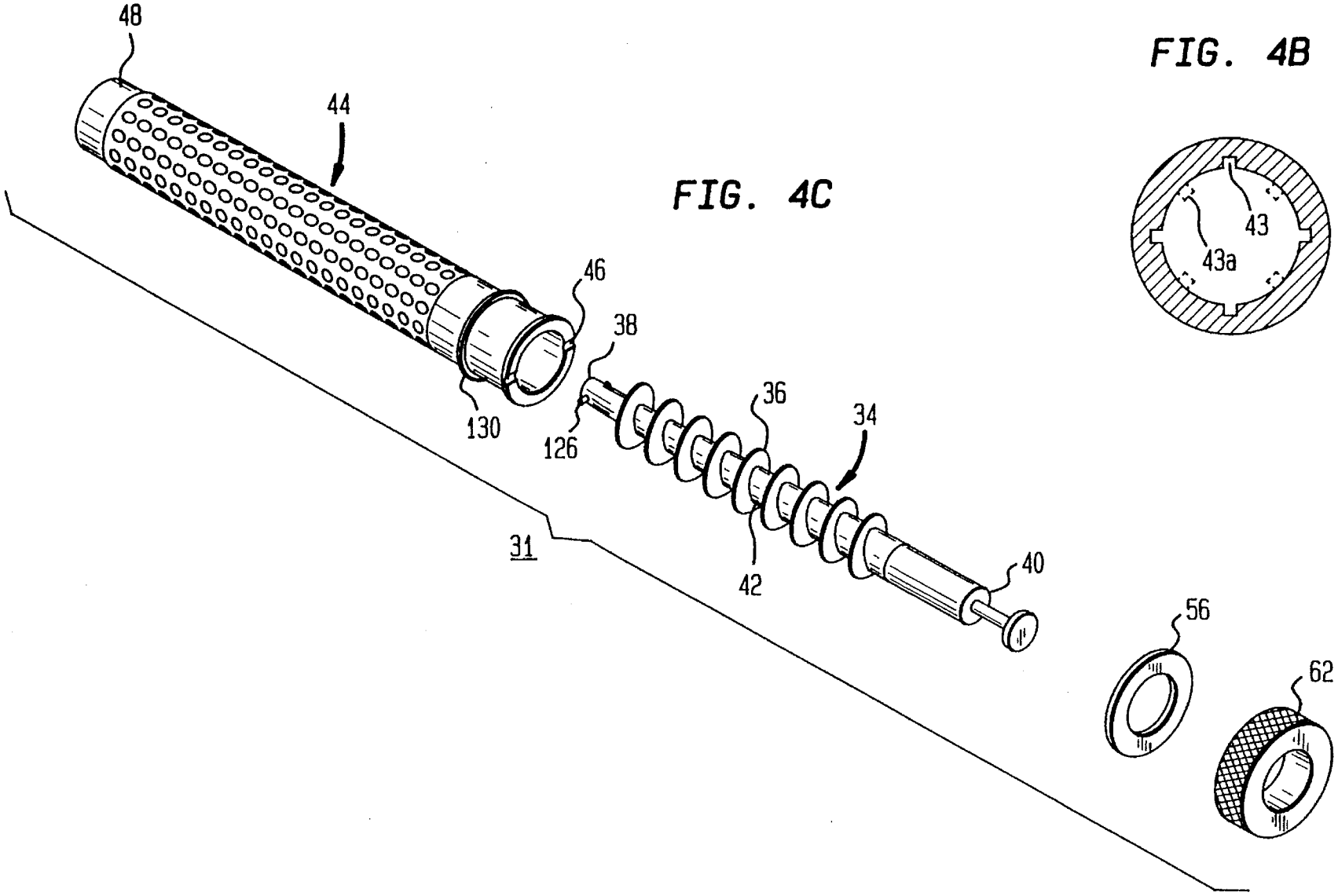
FIG. 4C is an exploded isometric view of the extraction assembly shown in FIG. 3.

FIG. 4A is a cut-away view of extractor 31. Nut 62 also includes an annular groove for receiving a restrictor ring 56. Exemplary restrictor 56 is a flat annular ring formed of cast polyurethane or other elastomeric type material (as best seen in FIG. 4C). The restrictor material may be adjusted between 50 and 100 durometer Shore-A scale to adjust the dryness of the discharged material. For example, 50–55 durometer material may be used effectively. The outer diameter of restrictor 56 is sized to fit over the discharge end 47 of sieve 44 in a tight sealing relationship. The inner diameter of restrictor 56 may be approximately the diameter of discharge end 40 of screw 34. The inner diameter of restrictor 56 may also be sightly larger (e.g., 1.5 cm larger) than the diameter of screw 34. Thus, restrictor 56 forms a seal extending radially from discharge end 40 to sieve 44.

During start up of system 10, restrictor 56 is substantially flat and substantially seals the end of extraction assembly 31, so that liquid is expelled from the side surface of sieve 44 as shown in FIG. 4A. Over time an increasing amount of solid material accumulates between the discharge end 40 of screw 34 and the discharge end 47 of sieve 44. At first, restrictor 56 maintains its flat shape, increasing the back pressure and compressing the solids at the discharge end. Gradually, as the back pressure increases, restrictor 56 flexes and opens up allowing the solids to be discharged from assembly 31, as shown in FIG. 4A.

Restrictor 56 provides an effective and adaptive mechanism for controlling the back pressure in the discharge end of extractor assembly 31. By varying restrictor 56, the dryness of the solid material discharged from extractor assembly 31 may be varied. For example, by using a stiffer material, or by providing restrictor 56 with a smaller inner diameter, the back pressure in the discharge end of extraction assembly 31 is increased, and the dryness of the solid material discharged from the system is increased.

Referring again to FIG. 3, a safety cover 60 is attached to gear box 52. Safety hood 60 prevents accidental contact between a worker and extraction assembly 31. There are no large protuberances within reach. All rotating elements 50, 56, 62 are relatively smooth and safe from accidental contact.

Because of the high rotational speed of sieve 44, the solid matter discharged from extractor assembly 31 tends to break off more readily without the need for a "cake cutting" apparatus at the discharge end 47. Although FIG. 4A shows solid material (e.g., wet food waste) being discharged in discrete pieces, some materials (such as relatively dry waste composed predominantly of paper) may be "extruded" from extraction assembly 31 in the form of a cylindrical shell or cake. In prior art systems, a cake cutter was used to break up the cylindrical shell into small pieces for disposal eliminating the need for a sharp cake cutter provides an advantage in terms of safety, because the discharge end is in a position that can be accessed by personnel.

Table 1 shows how the power consumption, discharge rate (of partially dried solids) and percent solids in the discharged material varied as a function of the rotational speed of the screen in an exemplary apparatus as described above.

TABLE 1

| RPM | HORSEPOWER | LB./HR. | % DRY |
|---|---|---|---|
| 198 | 2.87 | 155 | 37 |
| 242 | 3.19 | 158 | 37 |
| 283 | 3.59 | 173 | 39 |
| 340 | 4.39 | 180 | 38 |
| 382 | 3.18 | 123 | 43 |

As shown in Table 1, the power consumption is fairly flat from about 200 RPM to about 250. Although power consumption and percent dryness are both favorable at 382 RPM, there is a significant decrease in the discharge rate that substantially reduces the system throughput.

Figure 15:
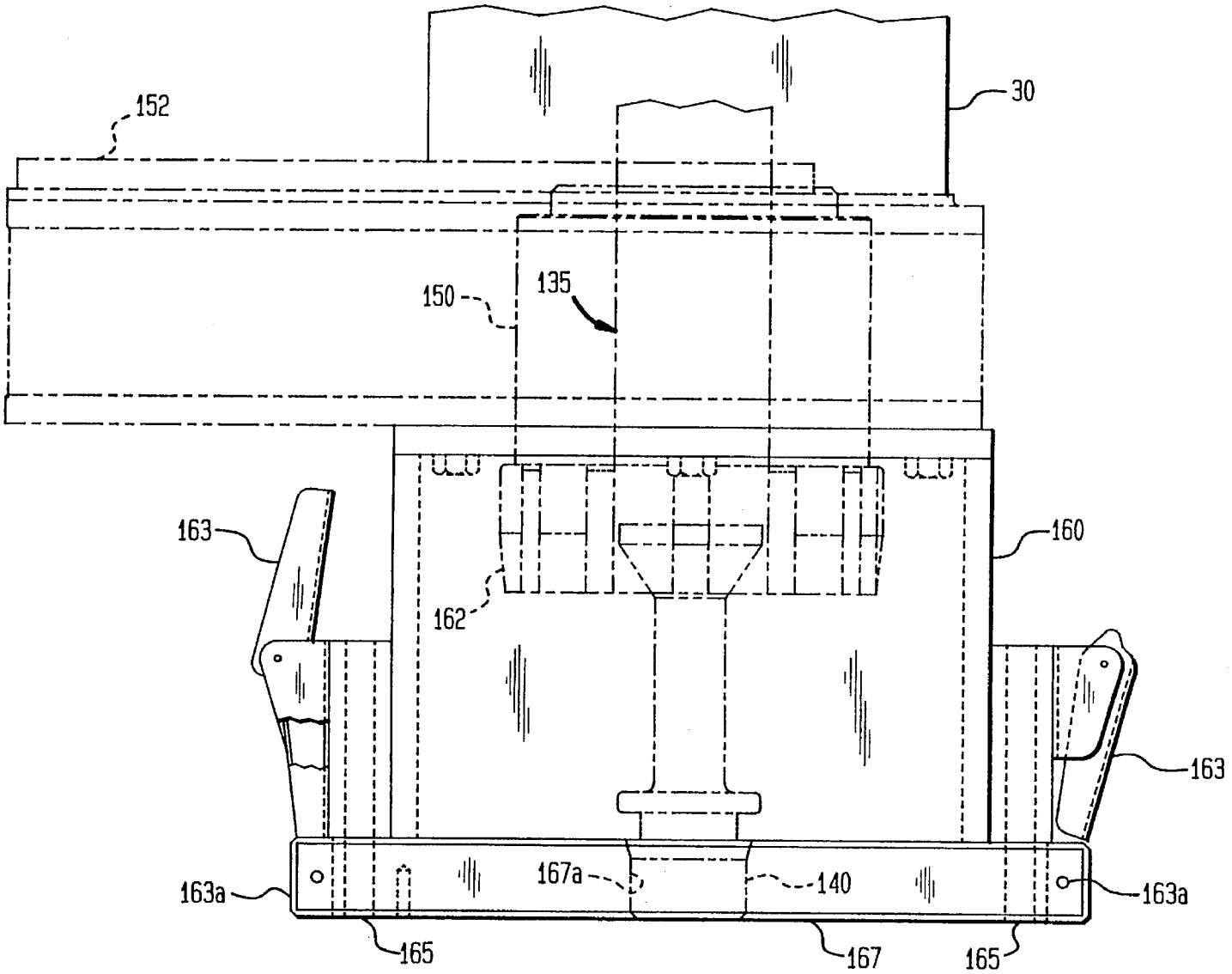
FIG. 15 is a plan view of a further exemplary embodiment of the discharge end of the system shown in FIG. 2.
Figure 16:
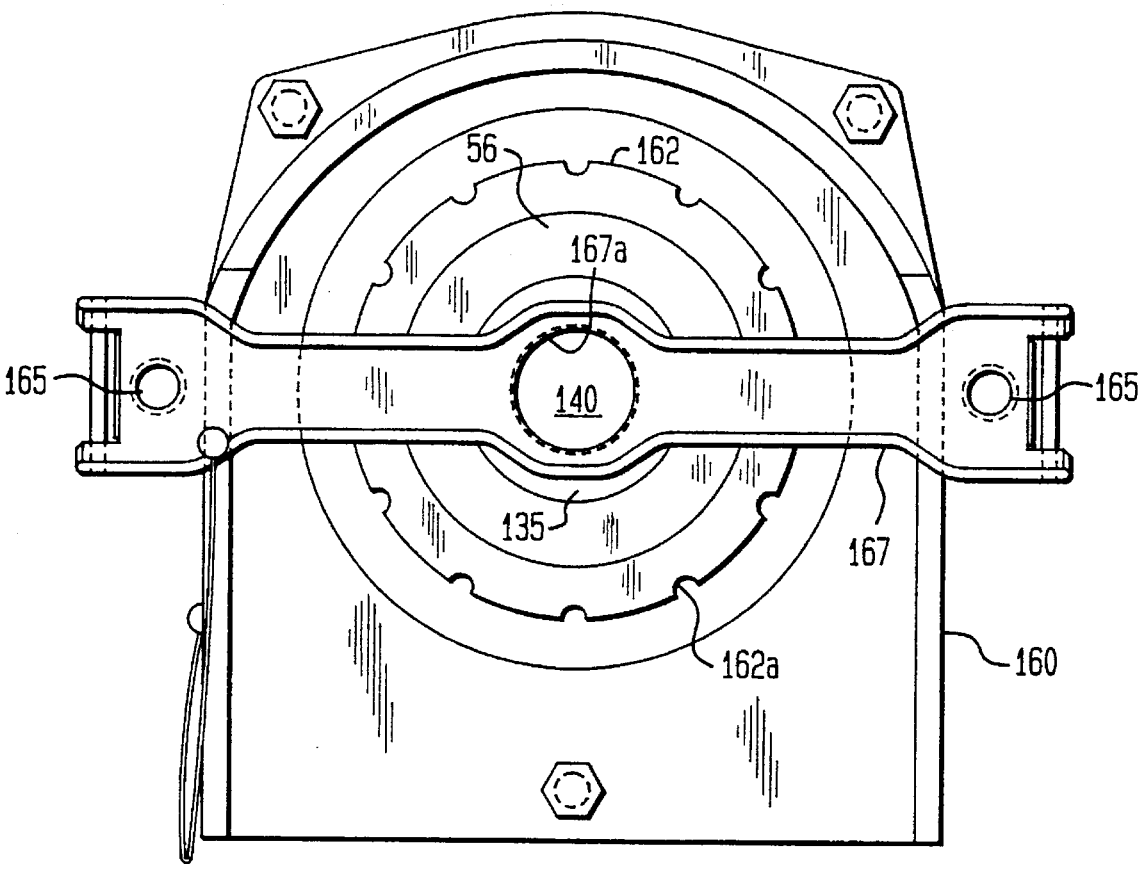
FIG. 16 is a front elevation view of the discharge end of the system shown in FIG. 15.
Figure 27:
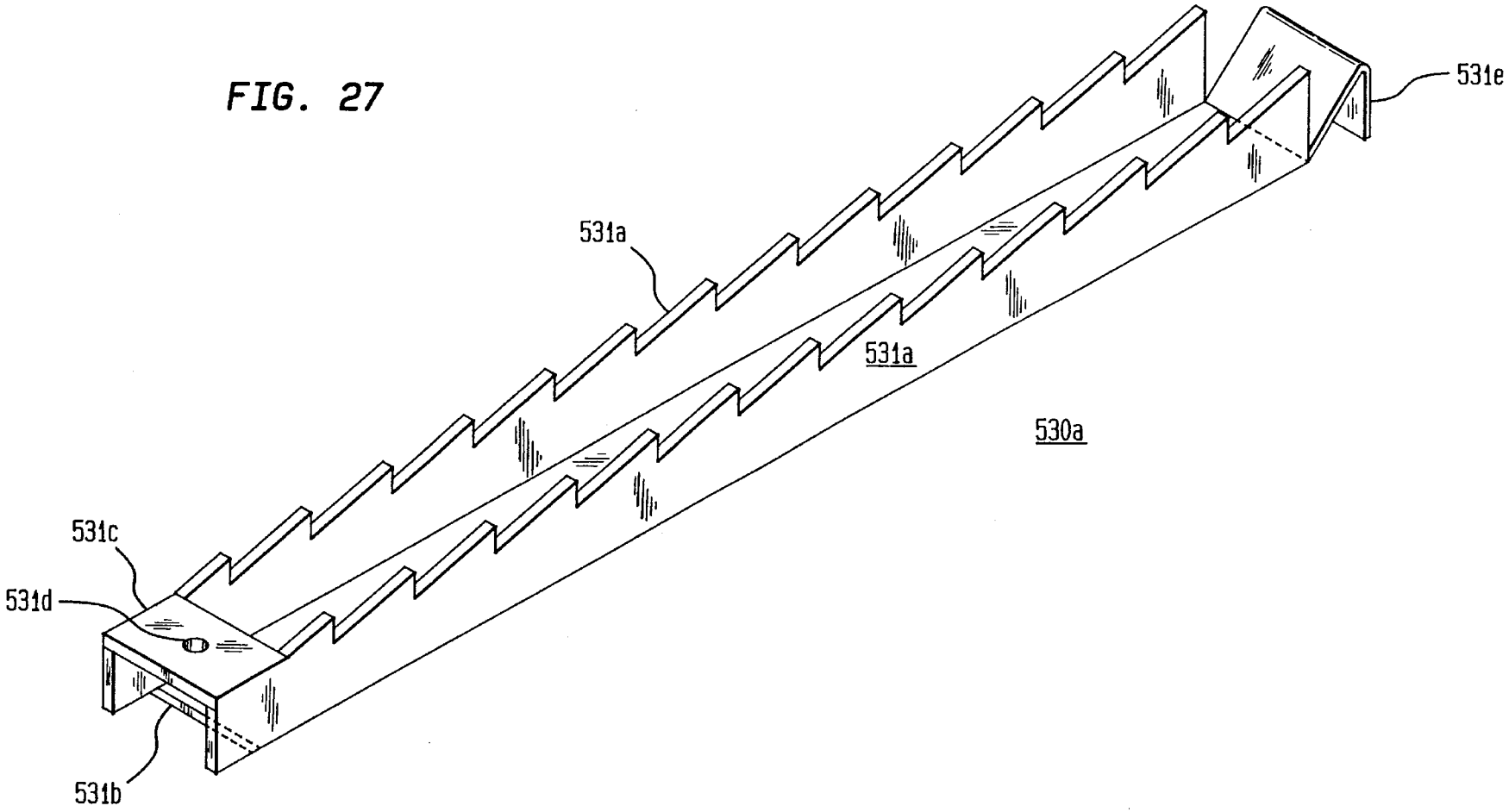
FIG. 27 is an isometric view of a feeder bar shown in FIG. 23.

FIGS. 15, 16 and 17 show a further exemplary mechanism for mounting extraction assembly 31. In FIGS. 15, 16 and 17, the screw 135 is supported at both ends. The input end 139 of screw 135 (shown in FIG. 4D) is detachably mounted to tank 12, as in the embodiment of FIGS. 2 and 3. As shown in FIG. 27, rotating mechanism 150 is cantilever mounted to the discharge end of housing 30. A screw support housing 160 is attached to the gear housing 152. Screw support housing 160 includes a detachable mounting mechanism 163 for attaching a support member 167. Support member 167 has a cylindrical hole 167*a*. The extraction screw 135 includes a cylindrical end 140 which is slidably received in cylindrical hole 167*a*. Housing 160 may be cast aluminum.

Installation of the extractor assembly of FIGS. 15, 16 and 17 begins with the same steps as described above with reference to FIG. 3. Screen 44 slides into bushing 16. Screw 135 slides into place in the inner sleeve 18 of tank 12 (shown in FIG. 5). End cap 162 and restrictor ring 56 are screwed onto drive hub 150 (shown in FIG. 15). As best seen in FIG. 16, two dowel pins 165 are provided on housing 160 to precisely locate support member 167 during installation and use. As shown in FIG. 15, two draw latches 163 may be used for quickly attaching support member 167 to housing 160, or for quickly detaching member 167. This mechanism supports screw 135 from the discharge end 140, without requiring the use of any special tools to remove support member 167. Other conventional fasteners (e.g., pins or bolts) may also be used to attach.support member 167.

Using this configuration, screw 135 and sieve 44 are maintained concentric to one another during use. This allows the outer diameter of flighting 138 to be very close to the inner diameter of sieve 44. So long as the longitudinal axis of screw 135 stays at the center of rotation of screw 44, the clearance between screw 135 and sieve 44 may be made very small. With a small clearance, screw 135 does not require brushing to effectively move solids toward the discharge end of the extractor assembly. As noted above, brushing is difficult and expensive to replace, so its elimination is desirable. By supporting the screw at the discharge end, contact between the outer edge of flighting 138 and sieve 44 is avoided, prolonging the life of these components, and reducing loading on motor 28.

IMPELLER ASSEMBLY

FIGS. 7, 8*b* and 9–12 show an exemplary impeller assembly 63. Impeller assembly 63 is designed to avoid blade damage by avoiding jamming of nonpulpable items such as flatware. Additionally impeller assembly 63 allows quick blade replacement without specialized tools.

Figure 7:
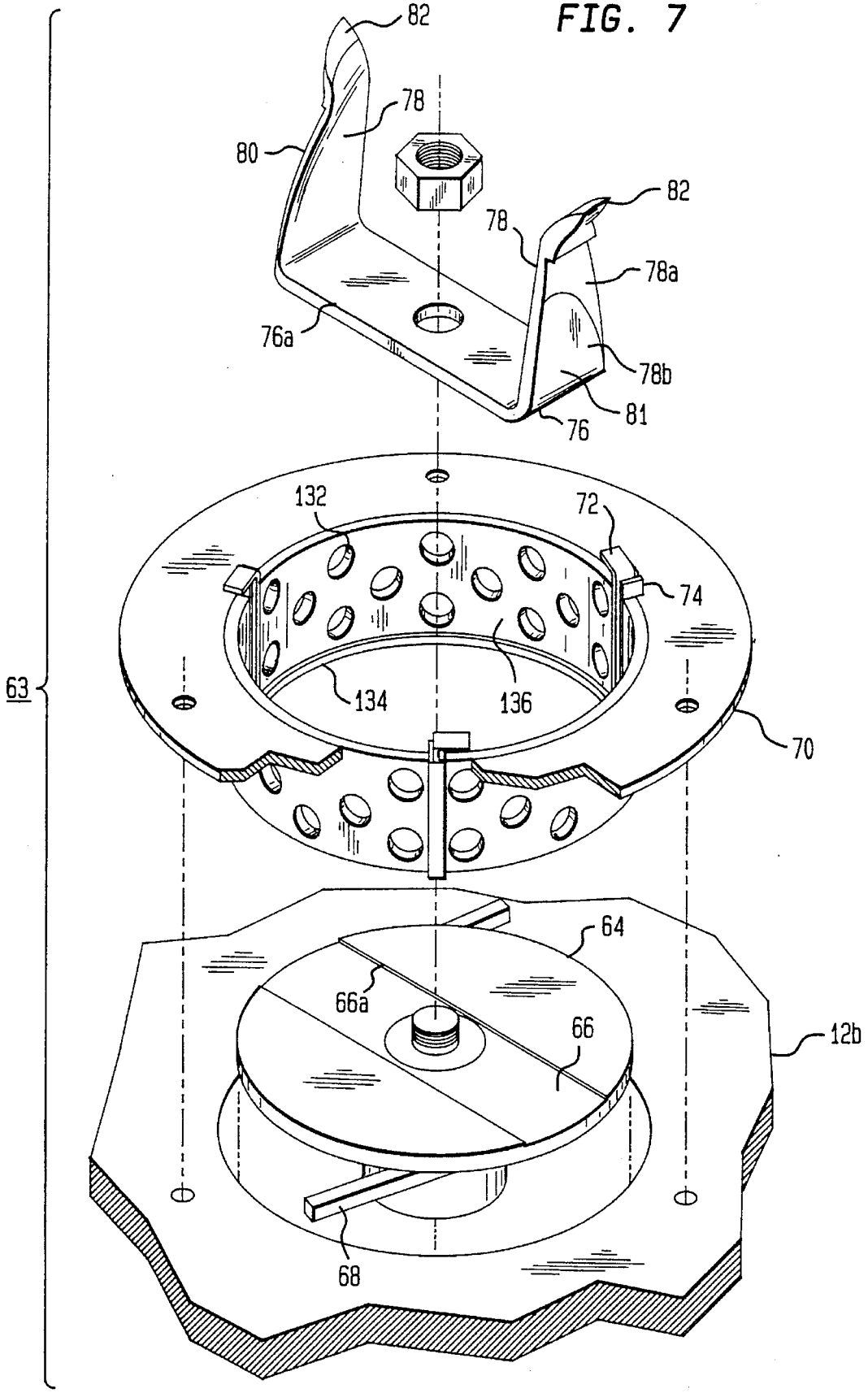
FIG. 7 is an exploded isometric view of the impeller assembly shown in FIG. 3.

FIG. 7 shows impeller assembly 63 in an exploded perspective view. Impeller assembly 63 includes a security ring or sieve ring 70 that attaches to the side wall 12*b* of tank 12. Sieve ring 70 includes a cylindrical sieve surface 136 that has a plurality of holes 132. The holes 132 are sized between 1.3 and 1.9 centimeters in diameter. Solid materials are retained within the main portion of tank 12 until the solids are ground down to a small enough particle size to pass through holes 132. An annular ring 134 is integrally attached to sieve ring 70, for retaining the stationary blade cutting member 72 as described in detail below with reference to FIGS. 9 and 10. A plurality of stationary blade holders 74 are integrally attached to the inner sieve surface 136. The blade holders 74 are also described with reference to FIG. 10.

A rotating disk impeller plate 64 is attached to the rotating shaft of motor 26 as best seen in FIG. 2. Impeller plate 64 includes a channel 66 for receiving a removable rotatable impeller blade assembly 76. It is not necessary to replace the entire impeller plate 64 if a cutting edge 80 (FIG. 7) of assembly 76 is damaged. Furthermore the side walls 66*a* of channel 66 provide a positive mechanical coupling for transmitting torque to the rotating blade assembly 76.

A second aspect of impeller disk 64 is the configuration of the impeller pumping ears 68. In typical impeller disks of the prior art such as disk 164 (shown in FIG. 8*a*), the impeller pumping ears 168 are aligned in the radial direction. Impeller pumping ears 68 (FIG. 8*b*) are neither aligned radially nor in a direction that is tangential to the impeller disk 64. The angle between impeller ear 68 and disk 64 is defined by angle 68*a*, and is approximately 45 degrees. By aligning impeller ears 68 at an angle 68*a* that is substantially less than 90 degrees, stringy pulped items (e.g., strips of plastic) are more likely to slide off of ears 68. These stringy items are less likely to become entangled on impeller pumping ears 68 and thereby contribute to power consumption imbalance and restriction to flow within chamber 22.

Rotating blade assembly 76 includes a plurality of shearing members 78 that are integrally attached to a base member 76*a*. To enhance cutting performance, the shearing members 78 are not perpendicular to the base member 76*a*. Shearing members 78 are inclined towards the inner surface 136 of the sieve ring 70. Exemplary shearing members 78 are inclined at an angle of approximately 6 degrees from the longitudinal axis of sieve ring 70. That is, angle 76*b* (shown in FIG. 11) is approximately 96 degrees. This allows the leading edge 80 of blade 78 to be helically formed to permit close clearances between shearing members 78 and stationary blade 72.

Shearing members 78 also include a bevelled cutting edge 80 that periodically comes into play with non-rotating blade member 72. Exemplary leading edge 80 is bevelled at an angle 76*c* (shown in FIG. 12) of approximately 32 degrees from the longitudinal axis of sieve ring 70. This bevel angle serves to deflect nonpulpable items from the blade assembly to reduce likelihood of jamming. Angle 78*c* may be varied between 30 and 60 degrees ejection of non-pulpable items.

Figure 8A:
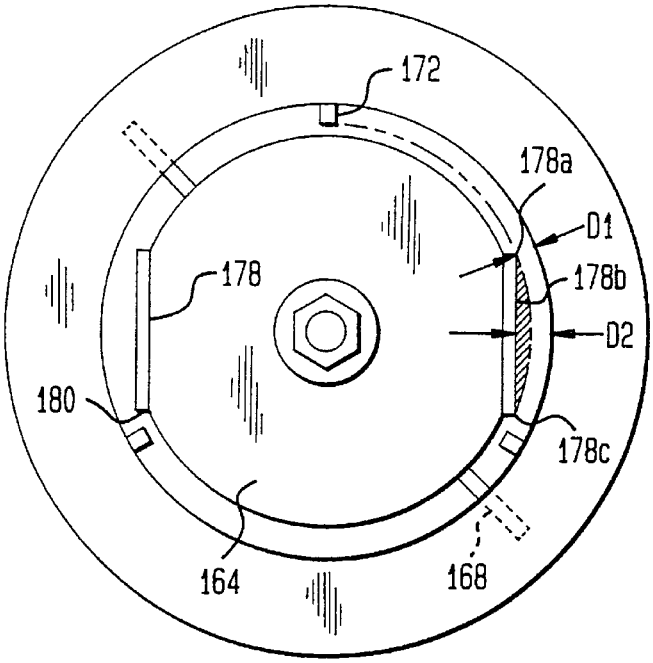
FIG. 8A (PRIOR ART)
FIG. 8*a* is a plan view of a prior art impeller assembly.
Figure 8B:
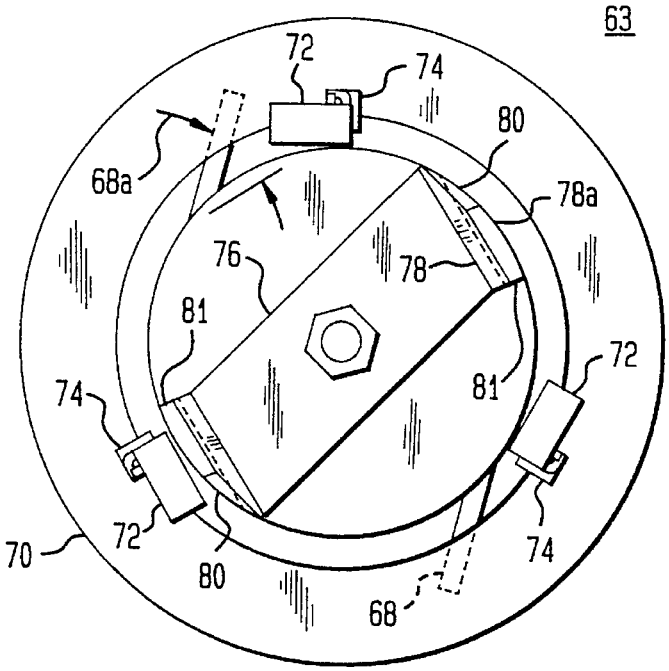
FIG. 8*b* is a plan view of the impeller assembly shown in FIG. 3.
Figure 11:
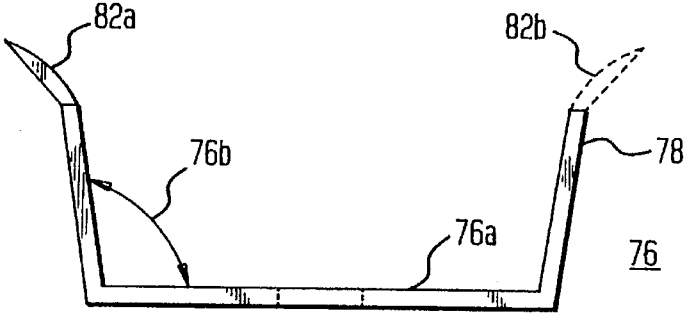
FIG. 11 is a front elevation view of the rotating blade shown in FIG. 7, after bending.
Figure 12:
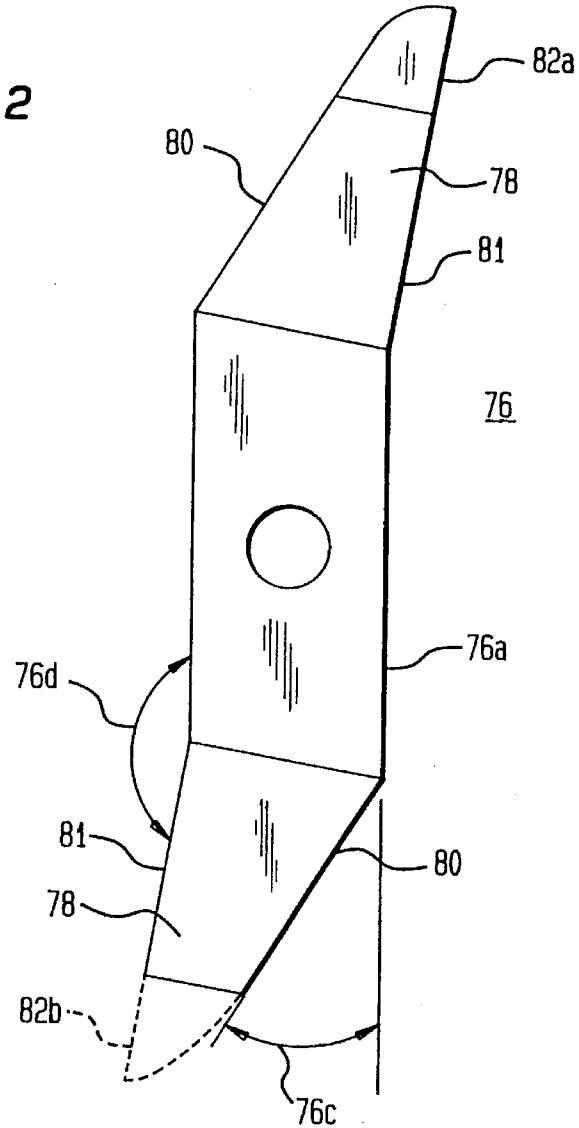
FIG. 12 is a plan view of the rotating blade shown in FIG. 7, prior to bending.

As shown in FIGS. 7 and 8*b*, the outer edge of members 78 are substantially constant in radial dimension. This is best seen in FIG. 8*b*, which is a plan view of blade assembly 76. The exemplary blade assembly may be formed from flat stock as shown in FIG. 12. (Alternatively, blade assembly may be formed by welding together a bottom piece 76 and two side pieces 78). The two cutting members are bent as shown in FIG. 11. The outer surface 78*a* of inclined shearing member 78 is then ground to be substantially cylindrical in shape, as shown in FIG. 8*b*. Thus lead cutting edge 80 is inclined to match the inclination angle 76*b* of member 78, and bevelled to match the bevel angle 76*c* of the front of member 78 with a substantially constant radius. This configuration results in a helical shape for member 80 as best seen in FIG. 7.

The advantage of the helical cutting edge 80 as compared with prior art blades is best shown by comparing rotating blade assembly 76 as shown in FIG. 8*b* with the prior art shown in FIG. 8*a*. FIG. 8*a* shows a conventional bevelled and inclined blade 178 that has a flat leading edge. The radial distance between blade 178 and stationary blade 172 varies along the length of the bevelled edge. This radial distance is smallest at the bottom 178*a* of rotating blade 178 and at the top 178*c*. The distance between the rotating and stationary blades is greatest approximately midway between the bottom and the top of rotating blade 178.

As shown in FIG. 8*b* the helical lead cutting edge 80 allows the inclined and bevelled shearing member 78 to maintain a substantially constant radial distance between cutting edge 80 and the stationary cutting member 72.

Another aspect of the rotating blade assembly 76 is the trailing edge 81. In the exemplary embodiment, trailing edge 81 is formed at an angle 76*d* of approximately 167 degrees from member 76*a*. The inventors believe that the combination of beveled leading edge 80 and beveled trailing edge 81 result in the formation of a localized low pressure region just behind trailing edge 81. During testing of an impeller assembly 63 as shown in FIG. 7, stringy pulped items, such as plastic straws were pulled back into the main portion 12*a* of tank 12. In prior art systems, these stringy items would often stick part way through the holes 132 of sieve ring 136. It is believed that low pressure behind trailing edge 81 resulted in the non-pulpable items being released from the holes 132. This low pressure region is believed to be small, because the overall direction of pulp flow is from main tank portion 12*a* to chamber bottom 22.

Figure 7A:
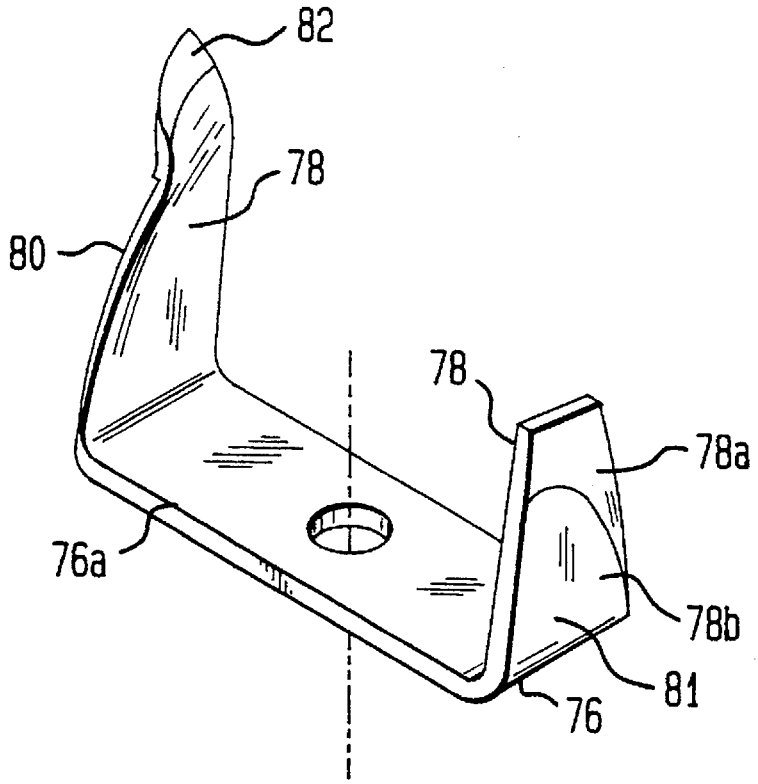
FIG. 7*a* is an isometric view of an alternate embodiment of the rotating blade of the impeller shown in FIG. 7.
Figure 9:
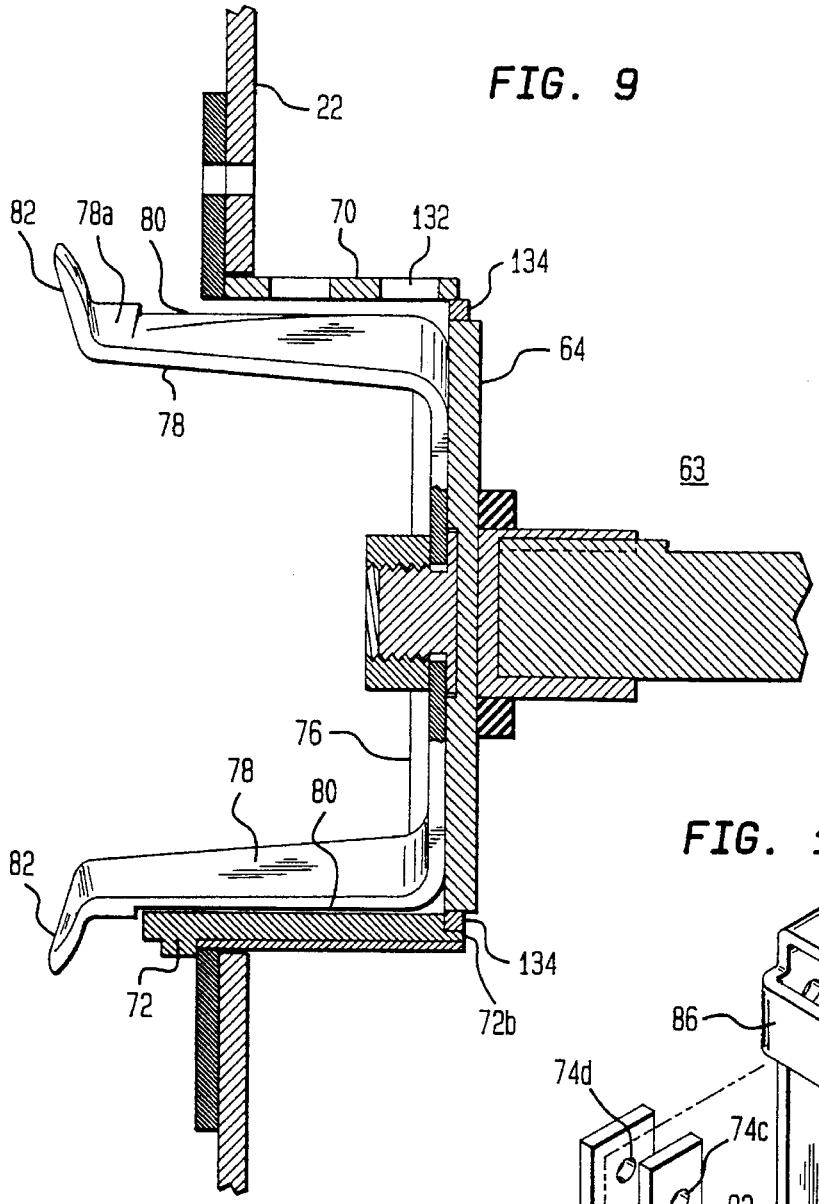
FIG. 9 is a detailed sectional view of the impeller assembly shown in FIG. 3.

As shown in FIGS. 7 and 9, rotating blade 76 may include an optional ear 82 at the end of each shearing member 78. The ears 82 increase the turbulence in tank 12. The ears also help to submerge floating objects (e.g., milk cartons), so that they are pulped. As shown in FIGS. 11 and 12, blade 76 may include either a single ear 82*a* on only one of the members 78, or a pair of ears 82*a* and 82*b* on the members 78. If two ears 82*a* and 82*b* are used and stringy materials or plastics (e.g., garbage bags) are pulped, these materials may wrap around and form a "bridge" between the ears 82 that may interfere with the chopping of other solid materials. By using only one ear 82 as shown in FIG. 7*a*, this problem is avoided.

Figure 10:
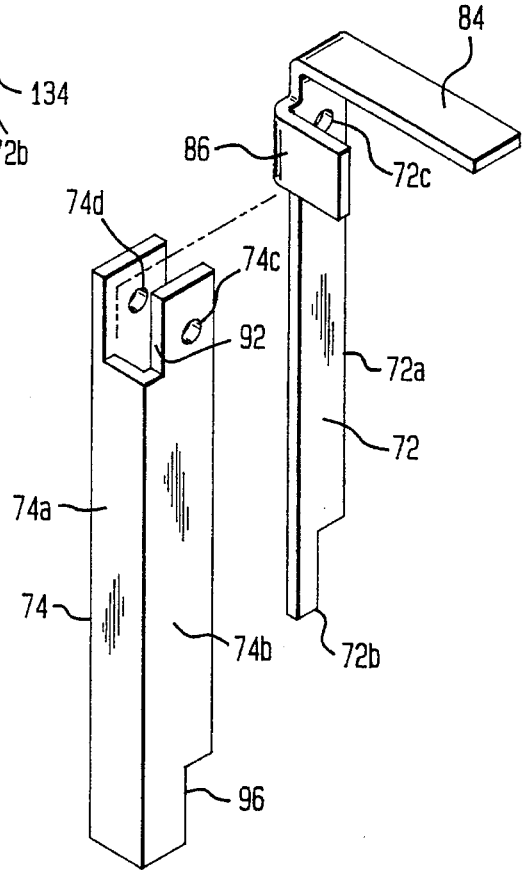
FIG. 10 is an exploded rear isometric view of the stationary blade assembly shown in FIG. 7.

FIG. 10 is an isometric view of the stationary blade assembly 72, 74. The stationary blade assembly includes a blade holder 74 integrally mounted to the inside surface 136 of sieve ring 70. Blade holder 74 is substantially in the form of a channel having a base member 74*a* and two side members 74*b*. At the end of blade holder 74 nearest to impeller disk 64, a cut out 96 in the form of a notch is provided, so that blade holder 74 conforms to the bottom ring 134 of sieve ring 70, as best shown in FIG. 9. Base member 74*a* is integrally attached to surface 136, for example, by TIG welding or casting.

Referring again to FIG. 10, at the other end of blade holder 74, another cut out 92 is provided on base member 74*a*. Cut out 92 is provided to receive a retaining tab 86 on the removable blade 72. Blade holder 74 has a through hole 74*c* and a threaded hole 74*d* for receiving a fastener, such as a screw (not shown), to attach cutting member 72.

Detachable cutting member 72 includes a cutting surface 72*a*. In the exemplary embodiment, cutting edge 72*a* is substantially straight and substantially square. Cutting member 72 is held in place on blade holder 74 by three features. At one end 72*b* of cutting member 72, member 72 rests against bottom ring 134 of sieve ring 70, preventing radial motion at end 72*b* of cutting member 72. Near the other end of cutting member 72 a retaining tab 86 is provided. In the exemplary embodiment retaining tab 86 is substantially rectangular. A through hole 72*c* is provided for receiving the fastener which also passes through hole 74*c* and is screwed into hole 74*d*.

To mount cutting member 72 in blade holder 74, member 72 slides into place and the fastener is placed through holes 74*c* and 72*c*, and screwed into hole 74*d*. Other fasteners, such as pins may also be used. Cutting member 72 may also include a handle 84 for ease of insertion into and removal from blade holder 74.

Removable blade 72 is formed from carbon steel and coated with a 0.005 to 0.125 millimeter thick finish of tetraflouroethylene rich auto-catalytic nickel plating. This coating is marketed by Nimet Industries, Inc. of South Bend, Ind., under the trademark "NICOTEF"®. The NICOTEF® coating prevents corrosion of blade 72, and reduces friction between blade 72 and holder 74 during installation and removal of blade 72.

Figure 13A:
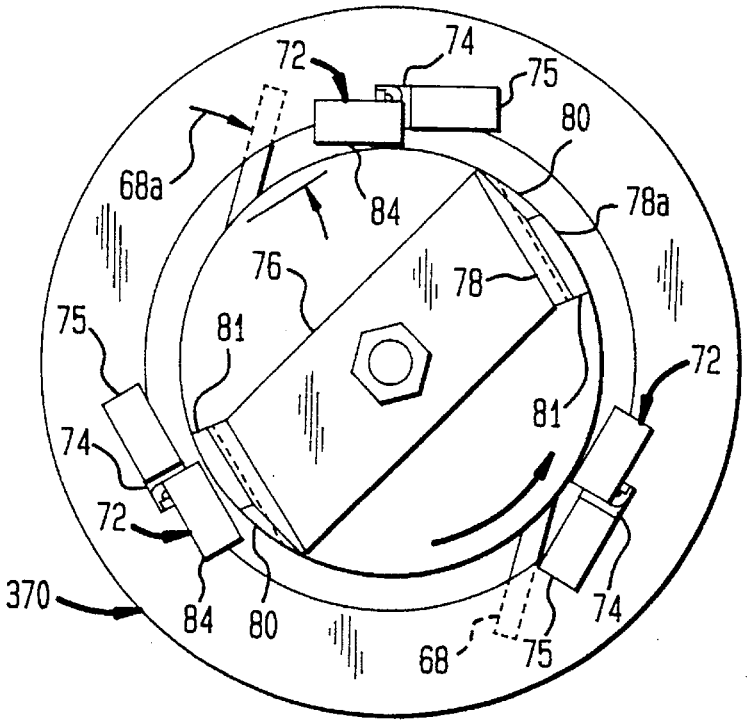
FIG. 13A is a plan view of an alternate embodiment of the impeller assembly shown in FIG. 3.
Figure 13B:
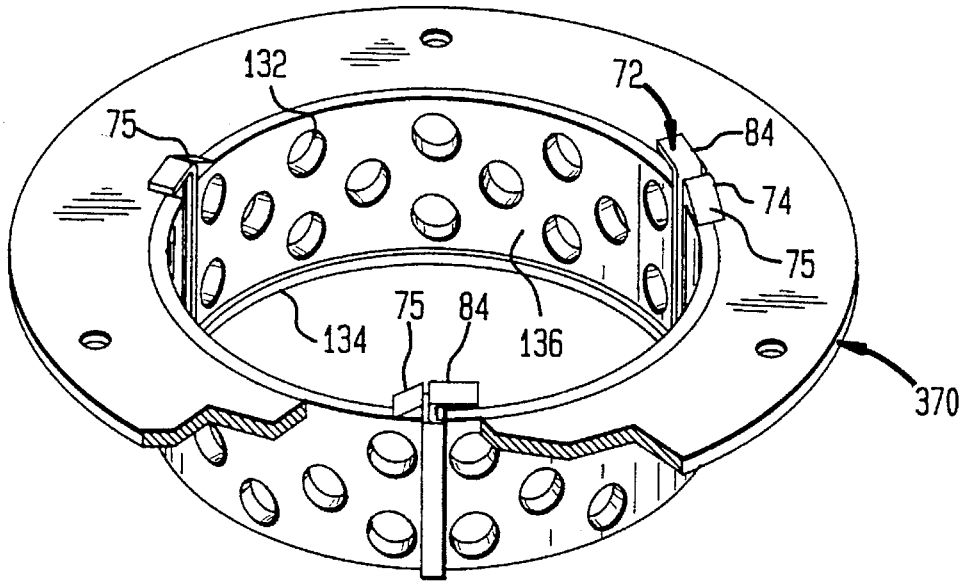
FIG. 13B is an isometric view of the impeller assembly shown in FIG. 13A.

FIGS. 13A and 13B show a further exemplary embodiment of the sieve ring 370. Sieve ring 370 is identical to sieve ring 70 (FIG. 8*b*), except that a ramp 75 is attached to the ring 370 adjacent to each respective blade holder 74, and opposite to the handle 84 of removable blade 72 (FIG. 10). Ramps 75 enhance the ability to eject non-pulpable items (in particular, flatware) from the impeller assembly 63. The combination of the bevelled cutting edge 80 and the ramp 75 cause flatware to be expelled, rather than becoming jammed between shearing member 78 and blade holder 74.

Figure 14:
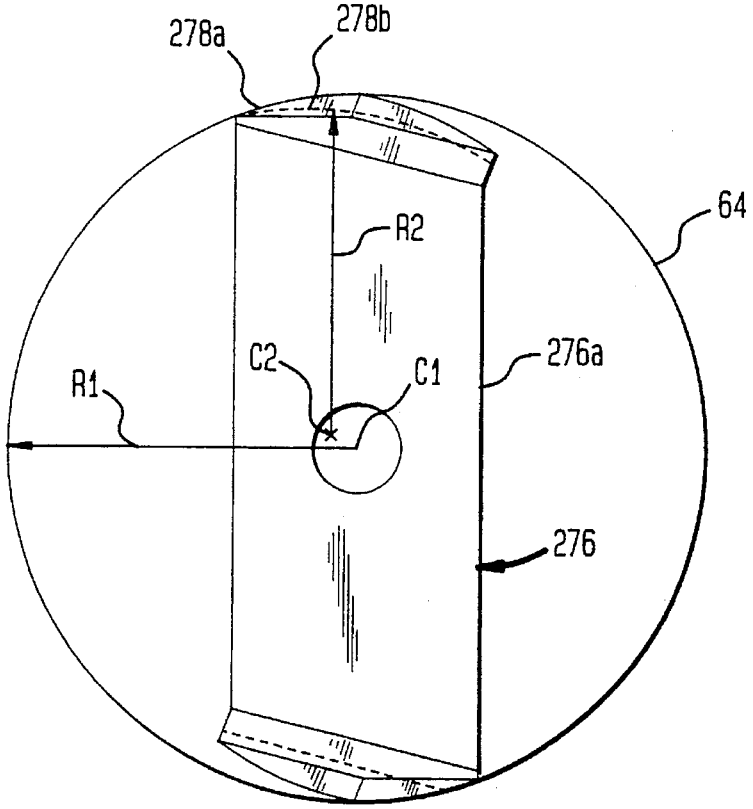
FIG. 14 is a plan view of a further exemplary embodiment of the rotating blade shown in FIG. 7.

FIG. 14 shows an alternative configuration for the rotating blade. Rotating blade 276 is the same as blade 76 (shown in FIG. 7), except that surface 278*b* is not flat (as is surface 78*b* in FIG. 7); surface 278*b* is ground to a smaller radius R2 than the radius R1 of surfaces 278*a* and 78*a* (shown in FIG. 7). Surface 278*a* is ground to the same radius R1 as is surface 78*a* (FIG. 7), and has a center of curvature C1 on the longitudinal axis of the impeller 64. Surface 278*b*, on the other hand, has a different center of curvature C2.

The impeller cutting ear 278 with curved back surface 278*b* was developed to enhance the low pressure area in the fluid trailing the cutting ear 278. The inventors believe that this volume of low pressure is instrumental in preventing sinewy material from clogging holes 132 in the sieve ring 70. Without the curved back surface 278*b*, some particularly tough materials (e.g., polystyrene) caused clogging problems during testing.

With curved back surface 278*b*, the flow of fluid passing the rotating cutting ear 278 is believed to be less turbulent (as compared to a planar back surface 78*b* in FIG. 7) in the area between the cutting ear 278 and the sieve ring 70. With less turbulent flow in this area the change in pressure across the two sides of the ear 278 is greater. This is analogous to the flow of air over an airplane wing in stable flight versus the flow of air in a stalled configuration. When this curved back surface 278*b* was tested, sinewy material did not clogged sieve ring 70.

Many other variations of the impeller mechanism are contemplated, including all of the variants described in copending U.S. application Ser. No. 08/223,526 filed Apr. 6, 1994, which is expressly incorporated by reference herein.

CONTROLS

Figure 6:
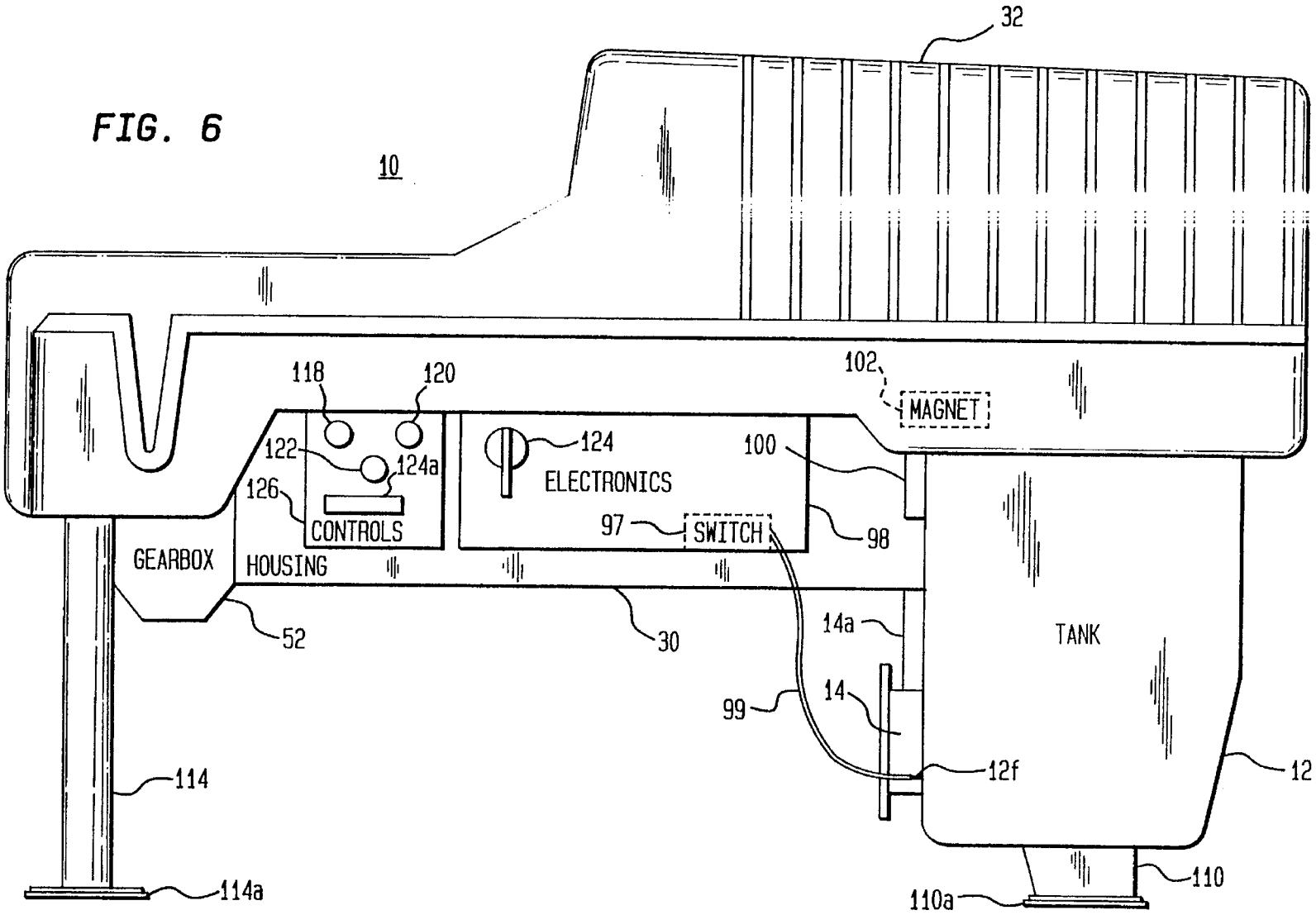
FIG. 6 is an elevation view of the system shown in FIG. 1.

FIG. 6 is a side elevation view of system 10. An enclosure 98 houses the electronics that control the operation of system 10. For safety, a ferromagnetic element 102 is included in tray 32. An associated sensor 100 is mounted on the apparatus. The exemplary sensor 100 is a Hall effect device mounted within enclosure 98. Other mounting locations are contemplated as well. Sensor 100 detects when the magnetic field is changed due to the removal of tray 32 (and magnet 102). If tray 32 is removed, sensor 100 produces and transmits a signal to electronics in enclosure 98, which then disable motors 26 and 28. This prevents inadvertent operation of the cutting blades 76 or extraction assembly 31 while the tray 32 is not in place. Other detectors may optionally be used in place of the Hall effect device 100. For example, a reed switch could perform a similar function.

Also included in enclosure 98 are controls for maintaining the appropriate water level within tank 12. During operation of system 10, a portion of the water supplied to the system is discharged along with the partially dried solids. Additionally, a portion of the extracted liquid is drained off through overflow nozzle 49, through a drain hose 109 (shown in FIG. 1) to a drain tee 107. This requires intermittent addition of water into tank 12 to maintain the appropriate fluid level.

Referring again to FIG. 6, in the exemplary embodiment pneumatically controlled switches 97 are contained in enclosure 98. Pneumatic switches 97 may be directly coupled by a small hose 99 to a port 12*f* at or near the bottom of tank 12, to sense the pressure (head) at the bottom of tank 12. Unlike conventional systems, there is no stand-pipe interposed in the line between switches 97 and port 12*f*. Other conventional level sensing mechanisms may also be used to determine the height of the liquid in tank 12. These switches 97 or sensors control an electric water valve to add water as required to tank 12. Other pressure sensors (e.g. strain gauges, piezoelectric elements or capacitive pressure sensors) are also contemplated.

A programmable logic controller (PLC) may be used to regulate the supply of fresh water based on the signals provided by switches 97. In the exemplary embodiment, a change in state of switch 97 (either from switch 97 open to switch 97 closed, or vice versa) only results in a change in valve position (from open to closed or vice versa) if switch 97 remains in its new state for at least a predetermined adjustable time period. The time period may, for example, be adjusted to six seconds. By selecting the minimum duration before a change in state of switch 97 impacts the water supply valve, false switch readings are eliminated. This may enhance the valve life, because the valves are not subjected to constant opening/closing operations when the water level is near the setpoint fill level.

One of ordinary skill in the art of programming a PLC could readily develop code (e.g., ladder logic) to implement this method. Optionally, other algorithms may be used to control water level. For example, deadband may be programmed into the water level control, so that the water valve is opened when the water is at a first level, and the valve is closed when the water reaches a second level higher than the first level. Furthermore, deadband may be combined with the use of a minimum time duration as described herein.

Although it is desirable to regulate the water level when starting system 10 and filling tank 12, or when waste is only introduced in small quantities, regulation of water level may be undesirable if large quantities of waste are placed in the tank at one time. If waste displaces a large portion of the water in the tank and raises the water level, a level control mechanism turns the water supply off, just when water is needed to process the large quantity of waste. Therefore, during steady-state operation, it may be desirable to control the water level by establishing a fixed fraction of operating time (or duty cycle) during which the water supply valve is open. For example, in steady state the valve may be open five seconds out of every 30 seconds. This insures that the water supply does not stop completely when a large quantity of waste is placed in tank 12.

It is understood by one skilled in the art that a conventional eductor may be used to draw waste treatment chemicals (shown in FIG. 21) into the water that is supplied to tank 12, so that the waste is chemically treated during the pulping process. Alternatively, a separate pump may be used to supply the chemicals.

Figure 20:
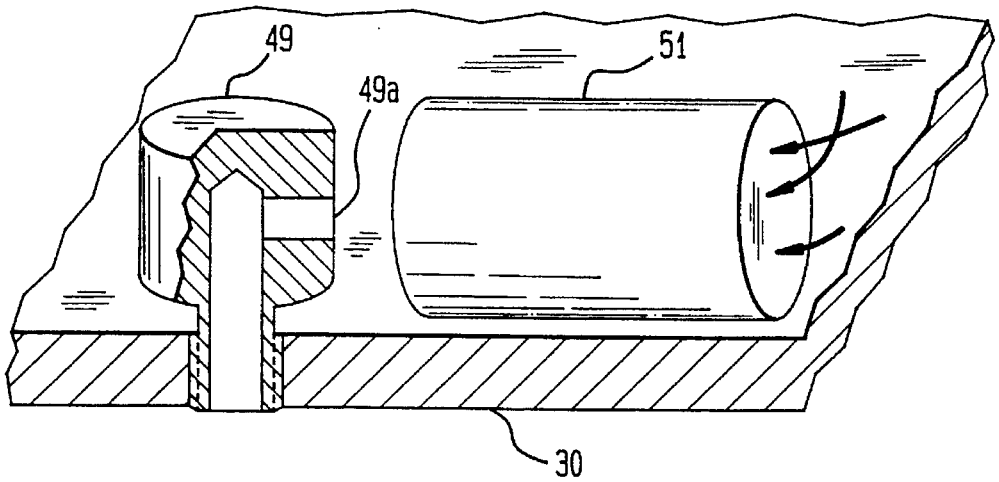
FIG. 20 is a side elevation view of the overflow nozzle shown in FIG. 2.

Referring again to FIG. 2, the mechanism for draining a portion of the return includes a overflow nozzle 49 positioned at the bottom of housing 30. The configuration of Nozzle 49 is best seen in FIG. 20. Nozzle 49 is in the form of an elbow, having a passage. The passage has a horizontal entrance 49*a* which may be oriented to face away from tank 12 (as best seen in FIG. 2). During testing of the exemplary apparatus, nozzle 49 was less likely to become clogged when it faced away from tank 12. The passage has a vertical output port 49*b*, through which liquid drains into drain hose 109 (shown in FIG. 1). Only a small portion of the extracted liquid is drained through nozzle 49, thus conserving water. An overflow channel 51 is provided in the form of a small, hollow horizonal cylinder aligned with entrance 49*a* of nozzle 49. Overflow channel 51 reduces fluctuations in the flow rate entering nozzle 49, separates entrained air from the overflow liquid, and reduces turbulence in the flow entering nozzle 49. Draining a portion of the liquid ensures that fresh water and, optionally, waste treatment chemicals, are added to tank 12.

System 10 also includes a simplified set of operator controls 126. A fill switch 118 actuates a valve to admit fresh water into tank 12. Respective controls 120 and 122 are provided for starting and stopping system 10 respectively. A power switch 124 may be provided for turning power on and off to the system.

A hose may optionally be attached to the apparatus and connected to the fresh water supply line. The hose is used to clean the top surfaces 32*a* and 32*b* of the tray 32.

BAG FEEDING APPARATUS

FIGS. 21–23 shows a second exemplary embodiment of the invention. System 500 includes apparatus 502 for automatically feeding whole bags 501 of waste into tank 512. Up to three bags 501 at a time may be placed on feeder bars 530*a*–530*e*. Flaps 516 cover an opening sized to receive one bag 501 at a time. Top surface 532*a* of tray 532 is about 125 centimeters long, roughly twice the diameter of a trash bag. If two bags are placed directly on tray 532, a third bag may be stacked on top of, and nested between, the first two bags.

Exemplary feeder bars 530*b* and 530*d* reciprocate, pushing bags 501 towards tank 512. Feeder bars 530*b* and 530*d* are driven by a single motor 538. Bars 530*a*, 530*c* and 530*e* are stationary in the example, but may optionally reciprocate (A crank shaft may be required for staggering the movement of feeder bars 530*a*–530*e* to prevent backward bag motion if all five of the feeder bars reciprocate). Stationary bars 530*a*, 530*c* and 530*e* engage bags 501 and prevent bags 501 from moving backward (away from tank 512) when bars 530*b* and 530*d* retract. Stationary anti-rotation strips 534 are mounted on the side walls 532*b* of tray 532. Strips 534 have angled tabs 534*a* that engage the sides of bags 501 and prevent backward rotation when bars 530*b* and 530*d* extend towards tank 512.

Two toothed stuffer bars 536 are housed in vertical cavities 532*c* on each side of tray 532, above the opening 532*d* at the bottom of tray 532. Waste is passed down through opening 532*d*, which opens into tank 512. The bottom 536*a* of each stuffer bar 536 moves through a circular path 536*b*, best seen in FIG. 24. Stuffer bars 536 move towards each other to engage bag 501 during a portion of the downward stroke.

Figure 25:
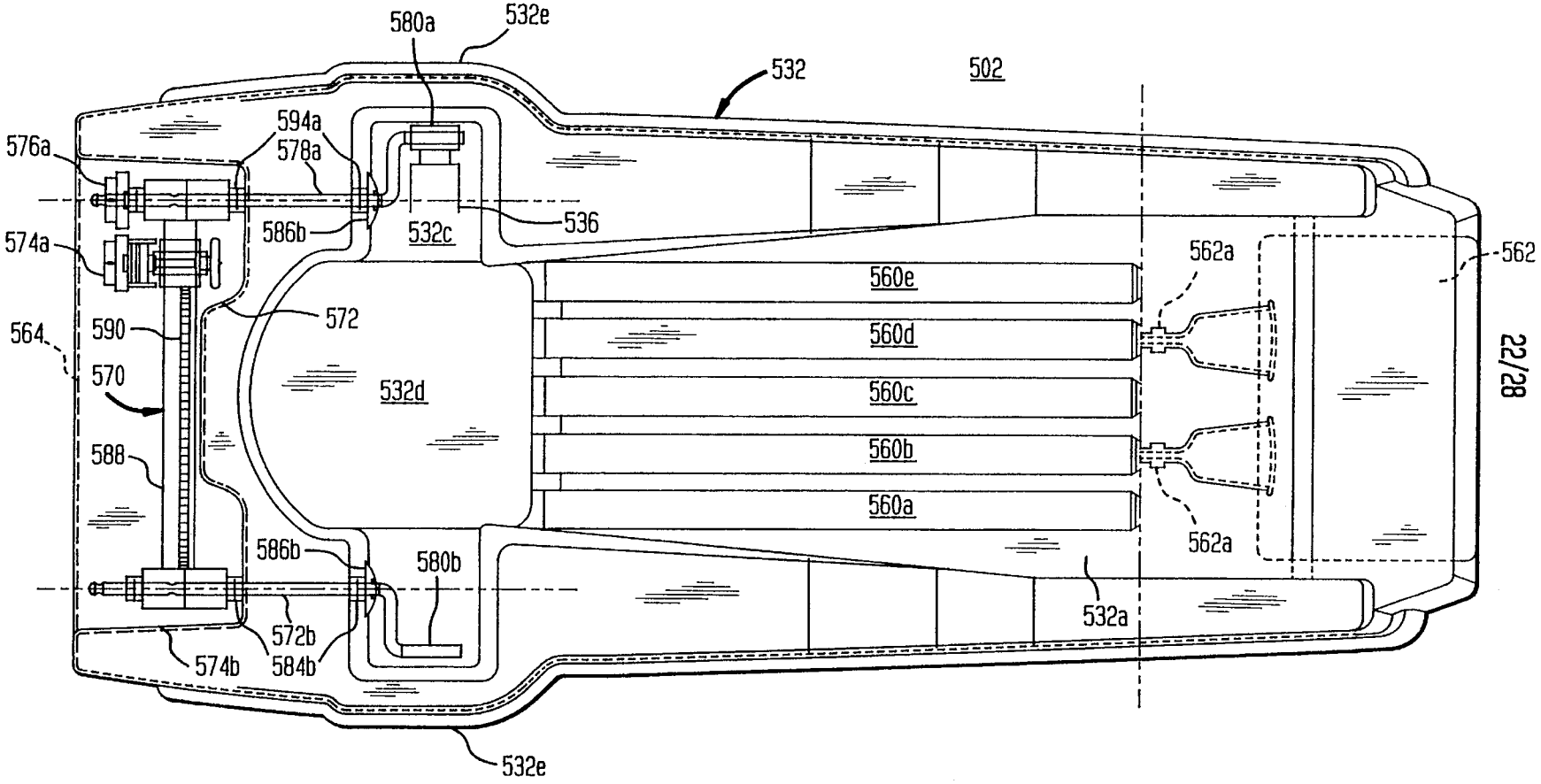
FIG. 25 is a plan view of the bag feeding apparatus shown in FIG. 22.

FIG. 25 is a plan view of tray 532. Tray 532 has the general shape of tray 32 (shown in FIG. 1), except for the following differences: The height of the rear portion of tray 532, and the width of opening 532*d* are sized to receive a full bag 501 of waste. Tray 532 has two vertical cavities 532*c*, which house stuffer bars 536. Bulges 532*e* in tray 532 accommodate the stuffer bar cavities 532*c*. Top surface 532*a* of tray 532 includes five rectangular channels 560*a*–560*e* for slideably receiving feeder bars 530*a*–530*e* respectively. The rear end of tray 532 includes a cavity 564 for housing the stuffer bar drive mechanism. The front end of tray 532 includes a cavity 562 for housing the feeder bar drive mechanism 539. A pair of passageways 562*a* accommodate the linkage which couples feeder bar drive 539 to feeder bars 530*b* and 530*d*. Tray 532 may be formed of fiberglass or plastic.

Figure 26:
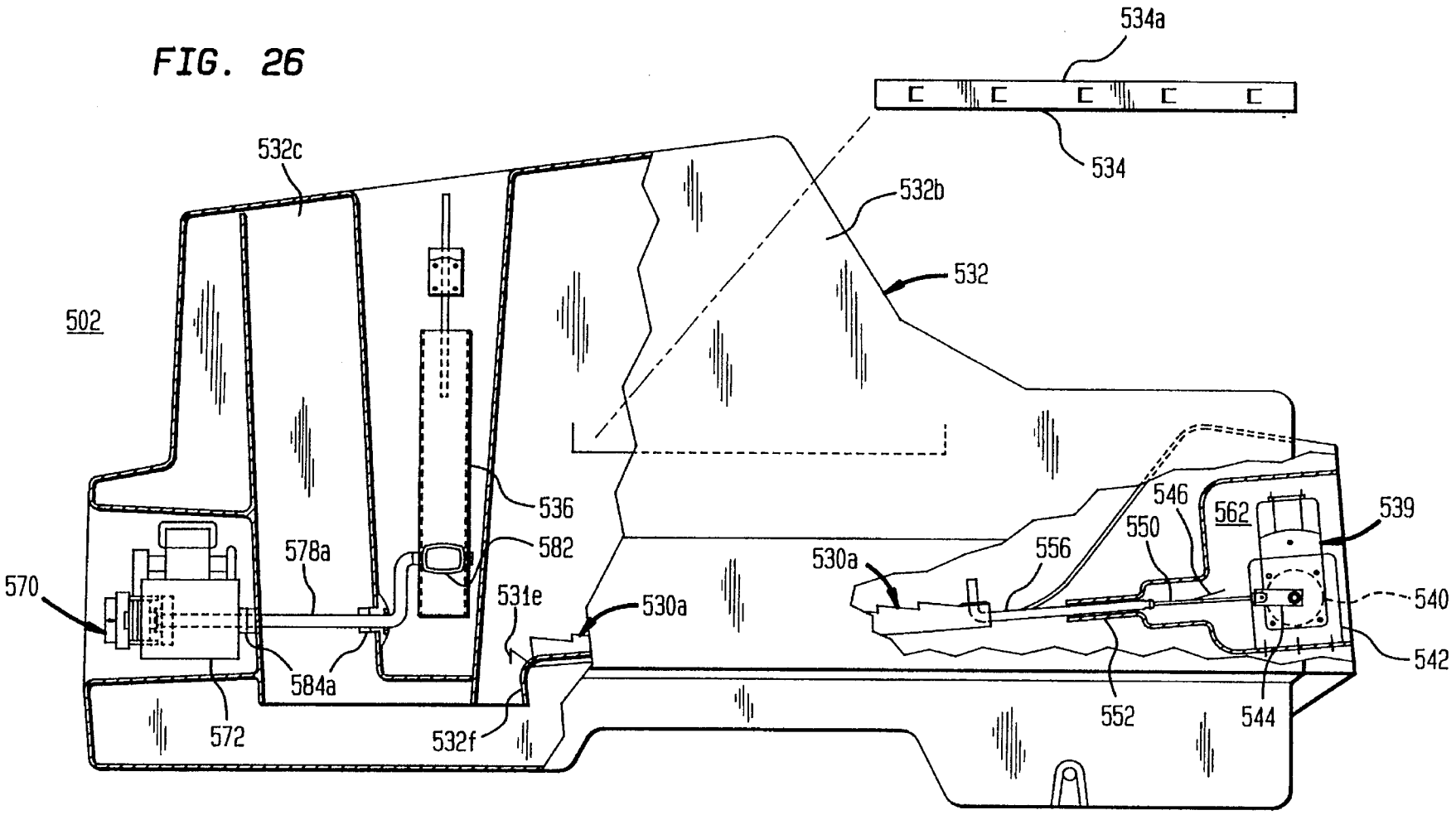
FIG. 26 is a side elevation view of the bag apparatus shown in FIG. 22.

FIG. 26 is a side elevation partial cut-away view of the bag feeding assembly 502. FIG. 26 shows the stuffer bar drive mechanism 539 (also shown in an exploded view in FIG. 28). Drive mechanism 539 moves feeder bars 530*b* and 530*d* back and forth with reciprocating motion. The motion of bars 530*b* and 530*d* are synchronized, so that both extend towards tank 512 at the same time.

FIG. 27 is an isometric view of an exemplary feeder bar 530*a*. Bar 530*a* has two toothed side walls 531*a* and a bottom wall 531*b*, forming a channel. A horizontal plate 531*c* is attached at the front end of bar 530*a*. Plate 531*c* has a hole for attaching bar 530*a* to drive mechanism 539 (described below with reference to FIG. 28). The rear end of bar 530*a* has a vertical plate 531*e*, which pushes bag 501 towards stuffer bars 536. When bar 530*a* is fully extended towards stuffer bars 536, plate 531*e* protrudes past the edge 532*f* of tray 532 (shown in FIG. 26) to ensure that waste is pushed completely over to opening 532*d* to tank 12.

Figure 28:
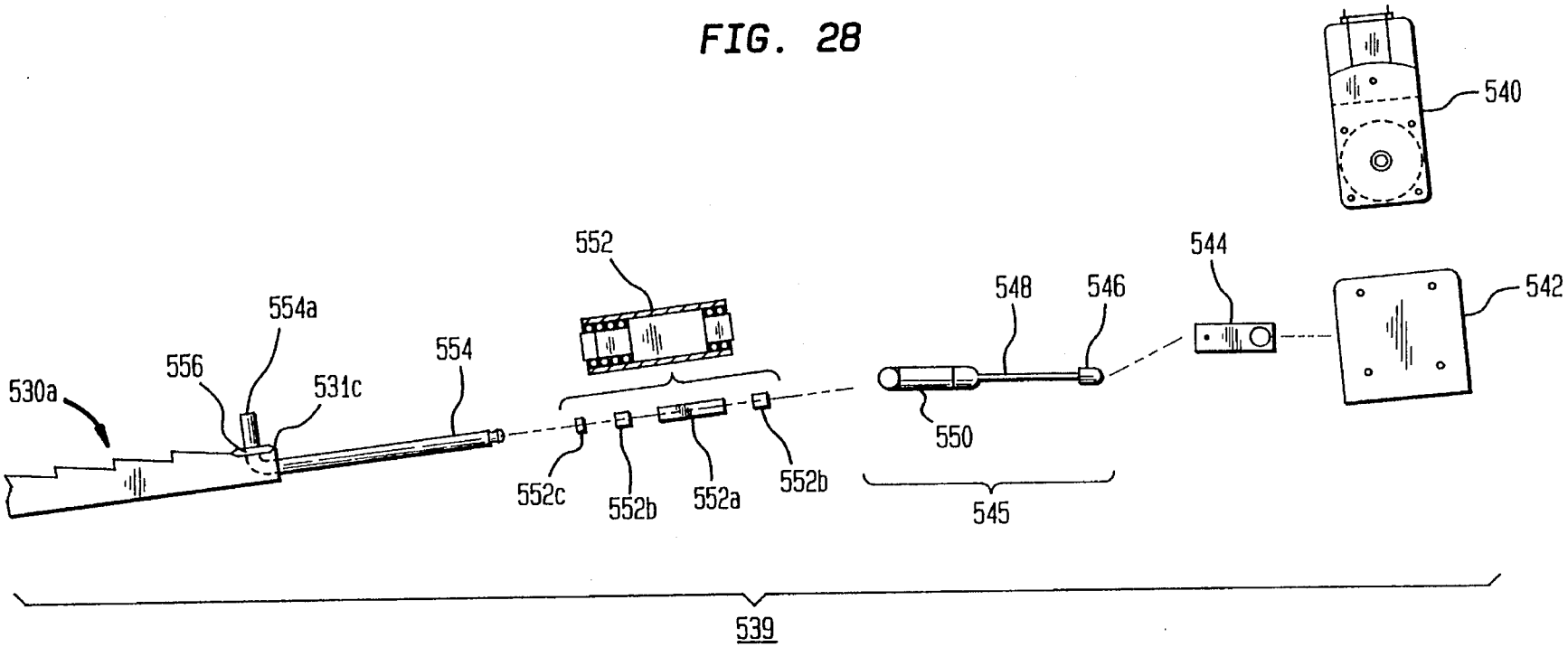
FIG. 28 is an exploded view of the feeder drive mechanism shown in FIG. 26.

FIG. 28 is an exploded view of drive mechanism 539. Only one side of the drive mechanism is shown (for driving bar 530*b*. The other side (for driving bar 530*d*) is identical, and is not described separately. Motor 540 is supported by a bracket 542. The shaft of motor 540 rotates at about three RPM (so bars 530*b* and 530*d* extend and retract about three times per minute). A crank arm 544 is attached to the shaft of motor 540, and rotates with the shaft of motor 540. A connecting rod assembly 545 is connected to crank arm 544. Assembly 545 includes a nylon ball joint 546, a connection rod 548 and a steel yoke end 550. A feeder drive slider arm 554 is pivotably attached to yoke end 550 using a clevis pin (not shown). When motor 540 and crank arm 544 rotate, connecting rod assembly 545 converts the rotation into a pure translation of slider arm 554. Crank arm 544 has a span of about 3.75 centimeters, so that the total distance between the retracted and extended positions of bars 530*b* and 530*d* is about 7.5 centimeters.

Slider arm 554 has an "L" shaped end 554*a* which fits into a hole 531*c* in feeder bar 530*a*. A retaining device, such as grommet 556 holds feeder bar 530*a* in place on slider arm 554. The stationary bars 530*a*, 530*c* and 530*e* slip onto stationary pins (not shown) that are mounted in channels 560*a*, 560*c* and 560*e*, respectively. The stationary pins have the same shape as end 554*a*, for mounting the feeder bars. To remove bar 530*a*, grommet 556 is removed; then bar 530*a* lifts right out. Using this structure, stationary bars 530*a*, 530*c* and 530*e* are identical to (and interchangeable with) reciprocating bars 530*b* and 530*d*.

A slider bearing assembly 552 is mounted inside of passageway 562*a* for slideably receiving slider arm 554. Bearing assembly 552 comprises a slider bearing housing 552*a*, two slider bearings 552*b*, and a rod scraper 552*c*. Rod scraper 552*c* scrapes waste material off of slider arm 554 if any waste is present, to prevent contamination of cavity 562 or drive mechanism 539.

Figure 24:
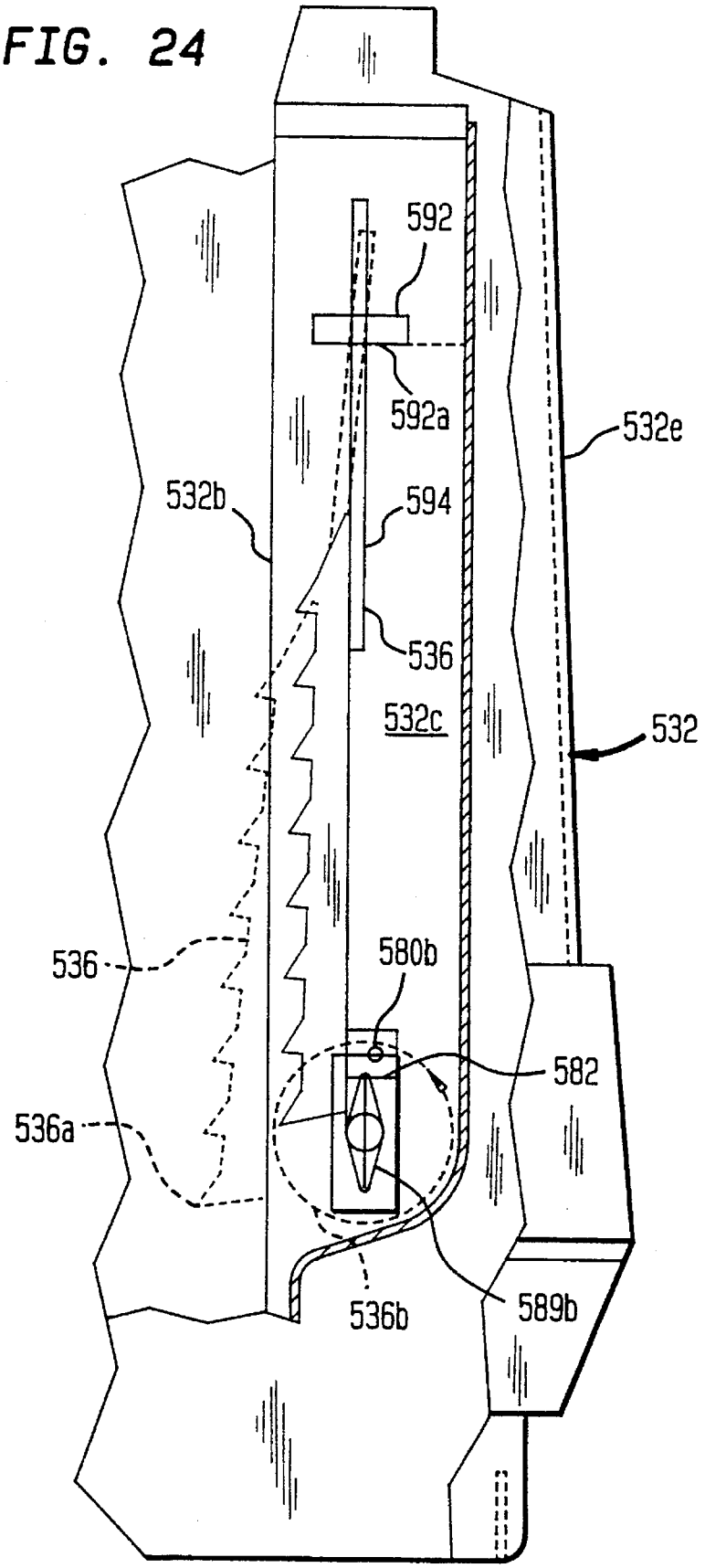
FIG. 24 is a rear elevation partial cut-away view of the system shown in FIG. 21.
Figure 29:
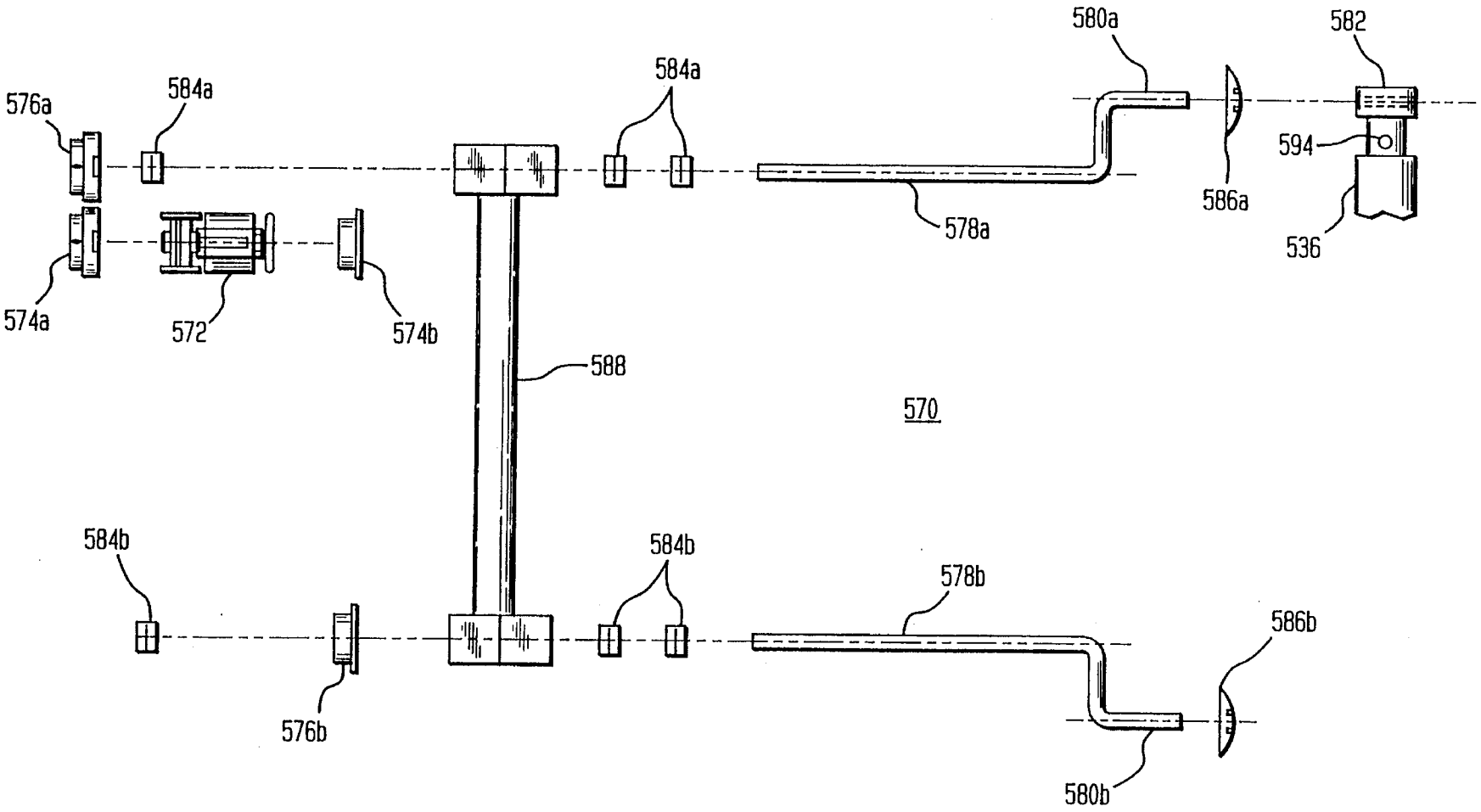
FIG. 29 is an exploded view of the stuffer drive mechanism shown in FIG. 25.

FIGS. 26, 26 and 29 show the stuffer bar driving mechanism 570. Drive mechanism 570 includes a single motor 572 mounted on a chassis 588. Motor 572 drives gear 574*a* and sprocket 574*b*. Gear 574*a* drives gear 576*a*, which in turn rotates stuffer crankshaft 578*a* at a speed of about one to two RPM. Crankshaft 578*a* is rotatably mounted using two flange bearings 584*a* attached to tray 532. Crankshaft 578*a* has an offset portion 580*a* which is located in cavity 532*c* and is rotatably received by a bearing 582 mounted on the back of stuffer bar 536. Because cavity 532*c* is open to the top of tank 512, a seal 586*a* is provided to prevent egress of waste from cavity 532*c*. When the shaft of motor 572 rotates, offset portion 580*a* revolves in a circular path around the axis of shaft 578*a*. This moves bearing 582 in a circular path, as shown in FIG. 24, causing the bottom of stuffer bar 536 to follow the circular path. Offset portion 580*a* is about five centimeters from the axis of crankshaft 578*a*, so the circular path has a radius of about five centimeters.

FIG. 24 shows the mounting of the top of bar 536. A lift rod 594 is attached to the back of stuffer bar 536. A slide bearing 592 slidably receives lift rod 594. Bearing 592 may be a pillow block bearing or a ball and socket type bearing. Rod 594 slides up and down within bearing 592, and pivots about the center 592*a* of the bearing. As shown in solid lines in FIG. 24, the teeth of stuffer bar 536 are in line with the side wall 532*b* of tray 532 when offset portion 580*b* of crankshaft 578*b* is positioned about ten degrees before top dead center.

FIGS. 25 and 29 show how drive mechanism 570 drives the second stuffer bar 536. Motor 572 drives sprocket 574*b* in synchronization with gear 574*a*. A chain 590 (FIG. 25) couples sprocket 574*b* to sprocket 576*b*. Sprocket 576*b* rotates at the same speed as gear 576*a*, but in the opposite direction. A crankshaft 578*b*, bearings 584*b*, and seal 586*b* are identical to crankshaft 578*a*, bearings 584*a* and seal 586*a*. Offset portion 580*b* of crankshaft 578*b* is 180 degrees out of phase with offset portion 580*a*, so that both stuffer bars 536 move inward towards the center of tray 532 simultaneously to engage bag 501.

Figure 30:
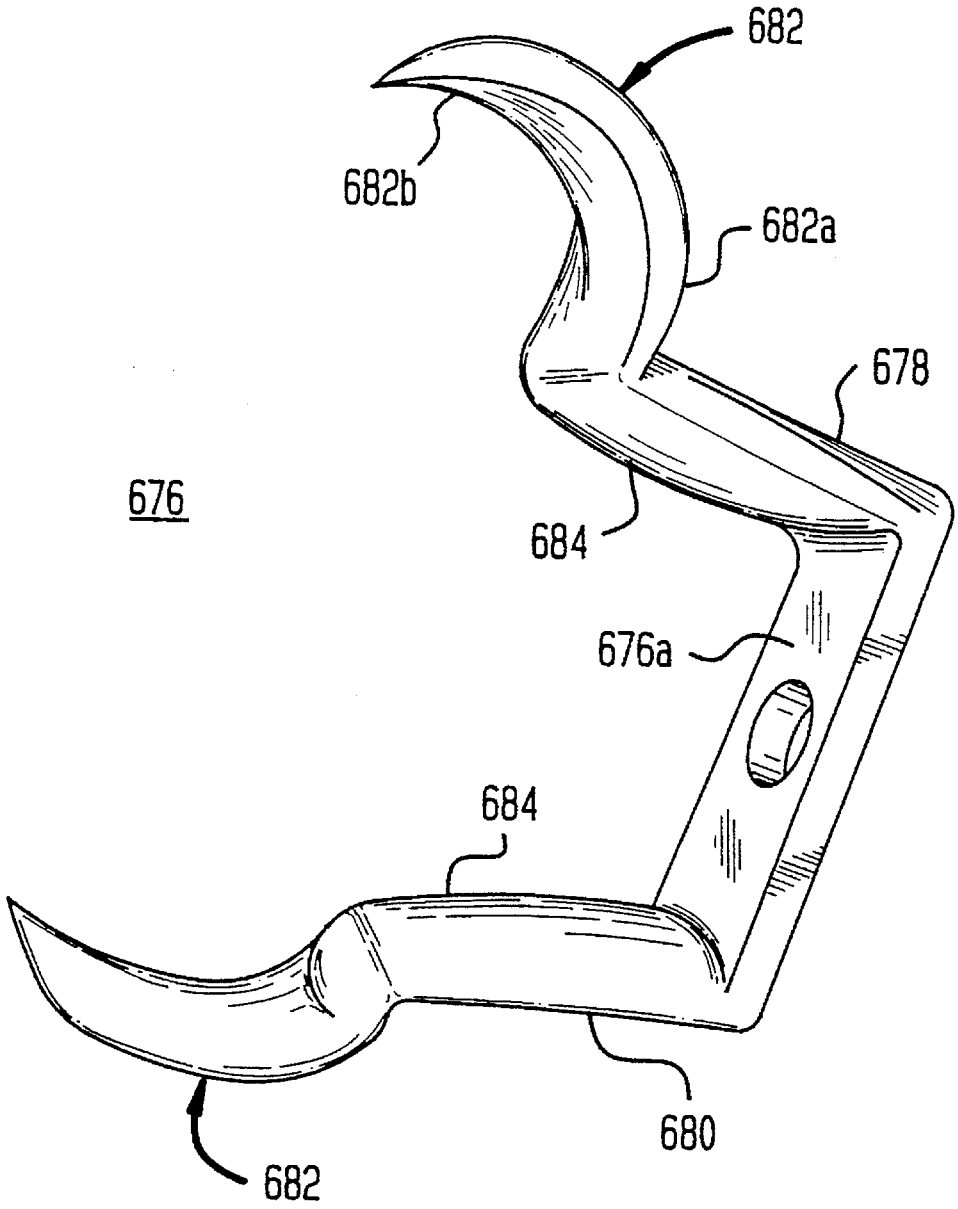
FIG. 30 is an isometric view of a pulping blade for the system shown in FIG. 21.
Figure 31:
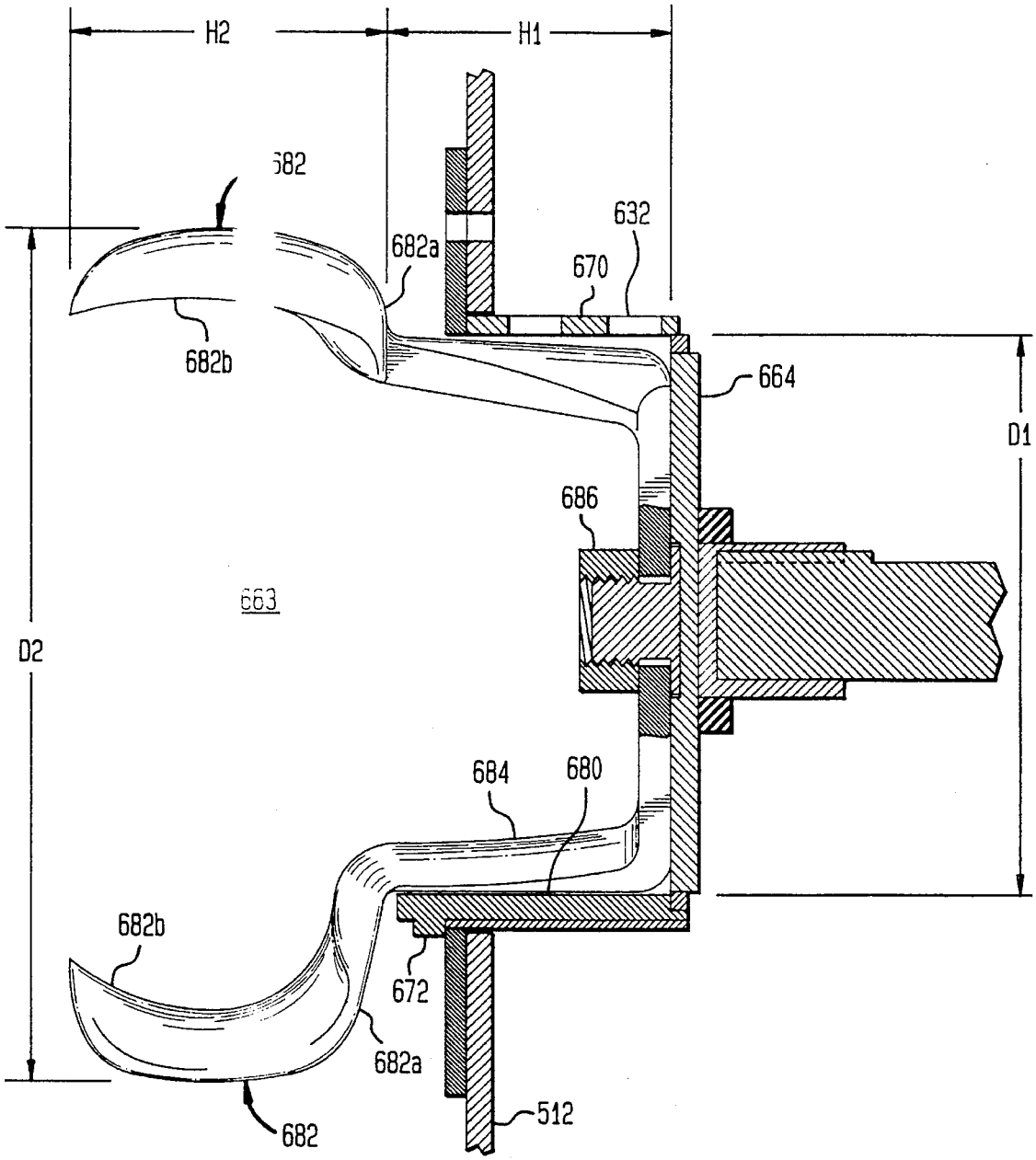
FIG. 31 is a cross sectional side elevation view of an impeller assembly which includes the blade shown in FIG. 30.

FIG. 30 is an isometric view of the rotating blade 676 of an impeller suitable for use in system 500. FIG. 31 shows the impeller assembly 663 for system 500, including blade 676. Blade 676 has large cutting ears 682, which have a diameter D2 that is approximately 1.5 times the diameter D1 of the security ring 670. The height H2 by which ears 682 extend past the end of stationary blade 672 is approximately equal to the height H1 of stationary blade 672. As a result, ears 682 of blade 676 reach toward the center of tank 512 to grab and dismember bag 501. Additionally, the curved shape of ears 682 resists collecting strands of material or formation of a "bridge" between the ears.

An additional feature of blade 676 is a convex inner surface 684 during testing of blade 676, convex surface 684 resisted collection of waste in the region between blade 684 and nut 686. In contrast, an otherwise similar blade (not shown) having a flat or concave inner surface collected a large ball of material and caused noticeable vibration and chatter.

The remaining elements of system 500 are similar to those of system 10 (shown in FIG. 1), with three exceptions. The size of tank 512 (shown in FIG. 22) is selected so that opening 532*d* between tray 532 and tank 512 can accommodate a bag 501. The bottom of tank 512 is substantially as wide as the top of tank 512. This provides more volume than the tank 12 (shown in FIG. 2). To provide the power required to process bags of waste, motor 526 of system 512 is more powerful (about 3700 watts) than motor 26 (about 2000 watts), shown in FIG. 1. Lastly, sieve ring 670 has 1.9 centimeter holes 632, compared to 1.3 centimeter holes in sieve ring 70 (FIG. 7). Larger holes allow larger particles to pass through sieve ring 70, achieving better water removal.

The exemplary bag feeding mechanism includes both vertical stuffer bars 536 and near-horizontal inclined feeder bars 530*a*–530*e*, so a person of average height may load bags on the system 500. Other variations are contemplated. For example, a single set of elongated vertical stuffer bars (not shown) may be used, with the entrance for loading bags positioned on top of the system. The feeder bars would not be needed in such a configuration.

The principles described herein may be applied in a variety of waste treatment and extraction systems. For example, the impeller assembly shown in FIG. 7 could replace the impeller in an otherwise conventional pulper. The extraction assembly 31 shown in FIGS. 2–4C could replace the corresponding equipment in an otherwise conventional liquid extraction system.

While the invention has been described with reference to exemplary embodiments, it is not limited thereto. Rather, the appended claims should be construed to include other variants and embodiments of the invention which may be made by those skilled in the art without departing from the true spirit and scope of the present invention.

What is claimed:

1. Waste pulping and liquid extraction apparatus, comprising:

a tank for containing liquid and solids having an input port for receiving liquid, a rotary disc impeller mounted therein for grinding the solids to form a mixture of liquid and solids;

a tray having an opening through which the solids are fed into the tank, the tray including means for moving the solids toward the opening and pushing the solids through the opening into the tank;

a stationary helical screw horizontally mounted directly to the tank and having a receiving end adjacent to the tank and a discharge end, the tank including means for conducting the mixture to the receiving end;

a sieve having a cylindrical sieve surface surrounding the screw through which the liquid drains, the sieve rotatably mounted to the tank;

means for rotating the sieve about the screw to move the solids longitudinally towards the discharge end; and a housing surrounding the sieve and mounted directly to the tank for communicating liquid that drains from the sieve back to the tank by way of the input port.

2. Apparatus according to claim 1, wherein the moving means includes a plurality of reciprocating stuffer bars for pushing the solids into the tank.

3. Apparatus according to claim 2, wherein the moving means includes a plurality of inclined reciprocating feeder bars for moving the solids towards the opening.

4. In a waste handling system, liquid extraction apparatus for removing liquid from a mixture of liquid and solids, comprising:

an input port for providing the mixture of liquid and solids;

a stationary helical screw having a discharge end;

detachable means for supporting the discharge end of the screw;

a sieve having a cylindrical sieve surface surrounding the screw, the sieve rotatably mounted to the input port; and means for rotating the sieve about the screw to move the solids along the screw longitudinally towards the discharge end, the rotating means including a rotatable collar, the collar including means for transmitting torque to rotate the sieve, wherein the sieve and the screw are slidably mounted to the input port and slidably removable from the apparatus by pulling the sieve and the screw through the collar.

5. Apparatus according to claim 4, wherein the supporting means includes means for aligning the screw so that the screw is concentric with the sieve.

6. Apparatus according to claim 5, wherein the supporting means is detachable.

7. Apparatus according to claim 5, wherein the screw is brushless.

8. Apparatus according to claim 4, further comprising restriction means adjacent to the discharge end for controlling backpressure in the sieve so that the liquid drains out of the sieve.

9. Waste pulping and liquid extraction apparatus, comprising:

a tank for containing liquid and solids having an input port for receiving liquid, a rotary disc impeller mounted therein for grinding the solids to form a mixture of liquid and solids;

a stationary helical screw horizontally mounted directly to the tank and having a receiving end adjacent to the tank and a discharge end, the tank including means for conducting the mixture to the receiving end;

a sieve having a cylindrical sieve surface surrounding the screw through which the liquid drains, the sieve rotatably mounted to the tank;

means for rotating the sieve about the screw to move the solids longitudinally towards the discharge end;

a housing surrounding the sieve and mounted directly to the tank for communicating liquid that drains from the sieve back to the tank by way of the input port; and means coupled to the housing for supporting the discharge end of the screw.

10. Apparatus according to claim 9, wherein the rotating means is attached to the housing, and the supporting means is attached to the rotating means.

11. Apparatus according to claim 10, further comprising an overflow nozzle for removing a portion of the liquid from the housing.

12. Apparatus according to claim 11, wherein the overflow nozzle includes an entry port which faces the discharge end.

13. Apparatus according to claim 9, further comprising a feed tray mounted above the tank for receiving solid waste material and for providing the waste material at a top portion of the tank.

14. Apparatus according to claim 13, wherein the tank includes sealing means for preventing leakage between the tank and the feed tray.

15. Waste pulping apparatus comprising:

a rotary disc impeller;

a sieve ring encircling the impeller and having a central axis;

first shearing means secured to the sieve ring and having a straight cutting edge that is parallel to the axis;

ramp means secured to the sieve ring and adjacent to the first shearing means for deflecting unpulpable material;

second shearing means secured to the impeller and having a plurality of shearing members, each shearing member having a beveled cutting edge for periodically coming into play with the straight cutting edge, the shearing member inclining towards the sieve ring and the beveled cutting edge inclining in the direction of rotation of the impeller so that unpulpable material is pushed above the second shearing means and away from the impeller, the beveled cutting edge having a helical shape to maintain a substantially uniform radial distance between the beveled cutting edge and the straight cutting edge as the beveled cutting edge and the straight cutting edge come into play.

16. Apparatus according to claim 15, wherein a single one of the shearing members has an extension member above the beveled cutting edge for causing turbulence in the waste reservoir.

17. Apparatus according to claim 15, wherein the first shearing means include a plurality of removable blades that are coated with a finish of auto-catalytic nickel plating that includes tetraflouroethylene.

18. Waste pulping apparatus handling food waste and food handling waste, comprising:

a rotary disc impeller;

a sieve ring encircling the impeller and having a central axis;

first shearing means secured to the sieve ring and having a straight cutting edge that is parallel to the axis;

second shearing means detachably secured to the impeller and having a plurality of shearing members, each shearing member having a beveled cutting edge for periodically coming into play with the straight cutting edge, the shearing member inclining towards the sieve ring and the beveled cutting edge inclining in the direction of rotation of the impeller so that unpulpable material is pushed above the second shearing means and away from the impeller, the beveled cutting edge having a helical shape to maintain a substantially uniform radial distance between the beveled cutting edge and the straight cutting edge as the beveled cutting edge and the straight cutting edge come into play, wherein at least one of said shearing members has an extension member extending outside of the sieve ring, the extension member positioned along a diameter approximately 1.5 times a diameter of the sieve ring.

19. Apparatus according to claim 18, wherein the extension member has a height approximately equal to a height of the sieve ring.

* * * * *

UNITED STATES PATENT AND TRADE MARK OFFICE

CERTIFICATE OF CORRECTION

PATENT NO. : 5,577,674
DATED : November 26, 1996
INVENTOR(S) : Altonji et al.

It is certified that error appears in the above-identified patent and that said Letters Patent is hereby corrected as shown below:

On the cover page, field [75], should read as follows:

Inventors: Robert W. Altonji, Coatesville, Robert J. Cohn, Dallas; Steven M. Eno, Strasburg; Albert Kolvites, Mountaintop, Linford R. Sensenig, Ephrata, Joseph J. Lehman, New Holland, all of PA.

Signed and Sealed this

Twenty-seventh Day of May, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,577,674
DATED : November 26, 1996
INVENTOR(S) : Altonji, et. al.

It is certified that error appears in the above-identified patent and that said Letters Patent is hereby corrected as shown below:

Title page, item [56], References Cited, OTHER PUBLICATIONS

Column 2 line 10, delete "item No. 1 above" and insert --Somat Side - Winder brochure--.

Signed and Sealed this

Twelfth Day of September, 2000

*Attest:*

Q. TODD DICKINSON

*Attesting Officer*

*Director of Patents and Trademarks*